US005417139A

United States Patent [19]

Bŏggs et al.

[11] Patent Number: 5,417,139

[45] Date of Patent: May 23, 1995

[54] DELIVERY SYSTEM AND METHOD FOR FLEXIBLE ARRAY

[75] Inventors: James D. Boggs, Herndon; John M. Geiger, Sterling, both of Va.

[73] Assignee: Unisys Corporation, Blue Bell, Pa.

[21] Appl. No.: 131,265

[22] Filed: Oct. 1, 1993

[51] Int. Cl.[6] ..... F41H 11/12; F42B 12/68

[52] U.S. Cl. ..... 89/1.11; 89/1.13; 102/504

[58] Field of Search ..... 89/1.13; 102/504, 403, 102/402; 244/3.28, 3.26, 3.27

[56] References Cited

U.S. PATENT DOCUMENTS

| | | | |
|---|---|---|---|
| 3,242,862 | 3/1966 | Stegbeek et al. | 89/1.13 |
| 3,724,319 | 4/1973 | Zabelka et al. | 89/1.13 |
| 3,861,627 | 1/1975 | Schoffl | 244/3.27 |
| 4,671,162 | 6/1987 | Adlam et al. | 89/1.13 |
| 4,724,768 | 2/1988 | Robinson et al. | 102/504 |
| 4,768,417 | 9/1988 | Wright | 89/1.11 |
| 4,776,255 | 10/1988 | Smith | 89/1.13 |
| 4,967,636 | 11/1990 | Murray et al. | 89/1.13 |
| 5,029,773 | 7/1991 | Lecat | 244/3.28 |

*Primary Examiner*—David Brown

*Attorney, Agent, or Firm*—Stanton D. Weinstein; Mark T. Starr

[57] ABSTRACT

Apparatus and method are provided whereby a single rocket or other projectile can be used to deploy a flexible array such as a net. There is provided to the rocket, via a sleeve and an attached flexible nose cone cap, a pair of pivoted, telescoping arms. The rocket is placed in a launch tube that has guides for the rocket, accommodates the swing arms, and has guides for the tow cables for the net. When the rocket is launched from the launch tube, the arms are swung apart on their single pivot such as with one or more loaded springs. After the arms have been swung out, they are held in place such as by a clam shell catch spring. While or after the spring-loaded arms are spread into place, the telescoped arms are extended such as by triggering a gas generator. Tow cables, one attached to each extreme end of an arm, spread out the net while the rocket is pulling it. Stabilization cables are provided that provide a central point of tow contact and better distribute some loads.

27 Claims, 18 Drawing Sheets

DELIVERY SYSTEM AND METHOD FOR FLEXIBLE ARRAY

FIELD OF THE INVENTION

The present invention relates to projectiles such as self-propelled projectiles, and more particularly to line carrying or filamentary material distributing projectiles. The present invention also relates to net handling apparatus.

BACKGROUND OF THE INVENTION

Explosive mines have long been used in warfare. Mines can be buried on land, anchored in the water, etc. For example, mines have been deployed in shallows, surf areas and beaches to defend against landings by offensive forces. For this purpose, mines can be sown in the Very Shallow Water (30 foot to 10 foot water depth) and Surf Zone (10 foot to 0 foot water depth) regions as well as on the beach itself. The Surf Zone starts at the 10-foot water depth and extends to the high water line on the beach. One method of neutralizing a series of mines in an intended landing or travel area is to individually locate each mine such as by probing or by using a metal detector, then placing an explosive charge on that mine, and then detonating that charge to neutralize the mine. Another method has been deployment of one or more Bangalore torpedoes. The Bangalore torpedo is a metal tube filled with explosives and equipped with a firing mechanism, particularly used for destroying barbed-wire entanglements, mine fields, etc. (S. B. Flexner, ed., *The Random House Dictionary of the English Language,* 2nd ed., unabridged (Random House, New York, 1987) page 163, 3rd column). The Bangalore torpedo is capable of clearing a narrow lane of a mine field. However, the Bangalore torpedo is both difficult and dangerous to deploy, especially if it is to be deployed while under fire. The series of metal tubes must be fitted together by hand on the battlefield near the location to be neutralized. This procedure thus leaves the users exposed to enemy gunfire. Since mines are usually deployed to be hidden from view, or at least made difficult to visually detect, such measures are difficult to accomplish, use up valuable time during which a defender could counterattack or otherwise react or respond to the offensive threat, and may prove ineffective if deployed mines are not neutralized in the intended area of travel.

Thus, there is a need for distributed explosives delivery, such as rocket-delivered explosives in support of in-stride amphibious assault such as in Surf Zone lane breaching. One such device is the rocket propelled M58A1 linear demolition charge, a 3100 pound system designed for ground emplacement and employment. Personnel and equipment handling this device are exposed to enemy gunfire when using this device because the time of exposure is long and there is little or no protection against direct or indirect fire. The line charge is transported into firing position by a forklift, crane or truck before installation of an accessory launcher rail for the rocket and assembly of the rocket firing connections. The M58 line charge and the MK22 rocket used therein and in the MICLIC are manufactured by Morton Thiokol, Shreveport, La. Both the M58A1 and its successor, the M58A3 or MICLIC, create a neutralized lane in a minefield about 10 meters wide and 100 meters long maximum against single impulse pressure actuated anti-tank mines. Another approach has been the trailer mounted MIne Clearing LIne Charge (MICLIC) system described in *Required Operational Capability (ROC) No. LOG* 1.63 *for the Trailer Mounted Mine Clearing Line Charge (MICLIC) System,* 7 Apr. 1983 (NTIS Accession Number AD A129426; also AD A127493) available from the National Technical Information Service, Springfield, Va., which document is hereby incorporated by reference herein. The MICLIC is a rocket-emplaced standard munition of the combat engineers in both the U.S. Army and the U.S. Marine Corps. The MICLIC employs a rocket to pull a rope-like explosive charge to clear a line of mines. The Mine Clearing Line Charge has been used for several years and most recently in Operation Desert Storm to supplant the hand emplaced Bangalore torpedo of World War II days. Details of the MICLIC, M58A3 can be found in the Mobility chapter of Army Field Manual No. 5-34, *Engineer Field Data* (Headquarters, Department of the Army, Washington, D.C., 14 Sep. 1987), which is hereby incorporated by reference herein. The mine-clearing line charge (MICLIC) is the U.S. Army terminology for the explosive system (M58 line charge) that is deployed from an M353 trailer. The M58 Linear Demolition Charge is approximately 350 feet long and consists of four sections of unit charges. A core of $\frac{3}{4}$ inch nylon rope and three strands of 100-grain PETN detonating cord pass through each such section. The four sections are secured in a continuous line by connecting eye-splices in the two rope ends with links. The three strands of detonating cord of one section are secured to the three strands in the next section by use of detonating cord connectors. The linear demolition charge contains five pounds of Comp C4 explosive per linear foot, which is divided into unit charges each consisting of two, $5\frac{1}{2}$ by $1\frac{1}{2}$ by $2\frac{1}{2}$ inch rectangular pellets weighing $1\frac{1}{4}$ pounds each. The two pellets in each unit charge are wrapped in a plastic bag placed around the core of nylon rope and detonating cord, and secured with filament tape. The exterior of the charge is covered with two knitted nylon sleeves tied at the ends. A rocket harness connector is attached to the front end, and a demolition charge fuse connector is attached to the rear end, of the linear demolition charge. The rocket harness connector is used to attach the line charge to the bridle cable of a rocket. This rocket pulls the linear demolition charge out of the charge container when the rocket motor is fired. The MICLIC uses the MK22, MOD4 rocket motor, and M58 line charges, both manufactured by Morton-Thiokol, Shreveport, La.

It has been attempted to fire multiple MICLICs side by side to create a wider cleared lane. However, this has proven unfeasible in practice because while multiple MICLICs might be pointed in parallel before launch, individual rockets may have minor differences in physical or performance characteristics that are within manufacturing tolerances, but cause deviations in flight patterns sufficient to cause uncleared gaps left between the individual areas cleared thereby.

To avoid some of these shortcomings, an explosive net can be considered. Both the U.S. Marine Corps and the U.S. Navy have been working with the concept of distributed explosives. The Marine Corps approach has explosives at the intersections of a net, with individual detonators. This approach, called Distributed Explosive Mine Neutralization System (DEMNS), is intended for use in neutralizing mines on beaches. This net has open cells of approximate dimensions of 2 feet by 2 feet with an explosive charge at each intersection of the net cords. This DEMNS net is described in D. P. Wirtz, *Preliminary Design and Accuracy Analysis of a Ground-Launched Multiple Rocket System for Breaching Mine Fields* (NTIS Accession No. AD-A061 672), which is hereby incorporated by reference herein. The DEMNS net can have carbon-fiber stiffeners between the explosives. Once the net has been spread onto the mined area, the net is command-detonated. The Navy concept is a net entirely comprised of explosives, for use in water. The U.S. Navy is developing a linear array of explosives in a net in which almost the entire net is an explosive charge, with the same command detonation feature. These explosives nets promise a higher probability of mine clearance than the previously used mine-clearing charges such as the M58A3 (MICLIC).

However, difficulty has been encountered in deploying such nets. Since (as with the other approaches described above) such a net must be deployed from a location at the front of the area to be cleared, it is necessary to have the net extended both forward and sidewards in order to be effectively deployed. Initial attempts to have two rockets fired simultaneously in different directions to spread and deploy the net have worked under ideal conditions on test ranges, but there is some doubt concerning tactical feasibility. The primary problem with dual rocket approaches is reliably coordinating the timing and the trajectories so that the net is properly placed and does not foul on the launch vehicle. Obviously, fouling on the launch vehicle is hazardous both to the vehicle and its crew. It is therefore desirable to eliminate any reliance on simultaneous, dual-rocket launches for deployment of a net. Thus, there currently is no reliable means of deploying an explosive net into a mined area for neutralization of such an area. The present invention fulfills this need.

The Navy concept is called variously a Distributed Explosives Net and Distributed Explosives Technology System (DETS). Presently, the only Navy two-dimensional explosive charge array design(s) are in exploratory development, which means that no approved system now exists. As opposed to the Marine Corps developments for land mine clearance, the Navy initiatives are underway for the investigation of this approach for underwater applications. The MICLIC is considered to work moderately well against single impulse pressure plate land mines of the World War II type. It is not considered as useful in destroying mines through sympathetic detonation, but is considered to be a pressure influence type of neutralization mechanism which causes the mine to detonate by functioning the fuze by the air pressure impulse. Pressure to destruct mines is very dependent on the mine type but essentially mines are very difficult to destruct/damage with atmospheric overpressure. Mines are typically buried in the Surf Zone and on the beach up to 2 to 12 inches deep, depending on local environmental conditions. The purpose of distributive charges is to remove one dimension of randomness (the clearing charges are fixed in a known pattern) by controlling the distribution of small shaped charges (DEMNS), or with an array of line charges (DETS), over an area. The U.S. Navy is developing a net of explosives (DETS) for Surf Zone mine neutralization but does not have a reliable means of delivering the net to the target. The present invention fulfills this need.

SUMMARY OF THE INVENTION

Accordingly, an object of the present invention is to provide apparatus and method for reliably deploying and spreading a net, web, flexible array or the like. For convenience, hereinafter the terms net, web, and flexible array will be used interchangeably, with each of these three terms including the other two terms within its scope.

Another object of the present invention is to provide apparatus and method capable of reliably deploying and spreading a collapsible net.

A further object of the present invention is to provide apparatus and method capable of being disposed on, and deploying and spreading a net from, an amphibious assault vehicle, a landing craft, a barge, a causeway, or other vehicles or platforms.

Still another object of the present invention is to provide apparatus and method capable of deploying a wide area explosive array or explosives net.

A still further object of the present invention is to provide apparatus and method capable of distributed explosives delivery.

Still another object of the present invention is to provide apparatus and method capable of distributed explosives delivery in support of in-stride amphibious assault and surf zone lane breaching.

Yet another object of the present invention is to provide apparatus and method capable of reliably deploying and spreading an explosives array from a single rocket delivery system.

A still further object of the present invention is to provide apparatus and method capable of deploying a net so that it is properly placed and does not foul on the launch vehicle or other launch platform.

Still another object of the present invention is to provide apparatus and method capable of launching and spreading an explosives array using a single rocket.

A still further object of the present invention is to provide apparatus and method capable of delivery of any of a variety of nets such as for a specific situation, with improved reliability, with a single rocket launch.

Yet another object of the present invention is to provide a self-propelled projectile capable of distributed delivery of a net or the like, such as an explosive net.

Briefly, these and other objects of the present invention are accomplished by a rocket-borne or other projectile-borne apparatus for deploying a flexible array. A rocket or other projectile is provided with a sliding collar to which is attached a pair of retracted, extendable arms connected to the flexible array. The projectile can be shipped in and deployed from a launch tube that has a plurality of guides for various portions of the resulting assembly. When the projectile is launched, inertia causes the collar to move rearwards on the projectile body to a stop or detent, and the arms are extended and spread out. Spread of the flexible array is accomplished with the arms, which are spread and extended after launch. The arms can be spread by spring loading the arms. The arms can be extended by gas generation. Since the flexible array is connected to the arms at or near their outboard tips, as the projectile pulls the net away from the launch location, the arms also spread out the flexible array. After a preset time, the rocket thrust is removed and the flexible array is allowed to fall and settle on the intended location, spread and fully deployed. This apparatus can be launched from a landing craft, boat, ship or other vehicle or platform.

Other objects, advantages and novel features of the invention will become apparent from the following detailed description of the invention when considered in conjunction with the accompanying drawings.

DESCRIPTION OF THE PREFERRED EMBODIMENT

Figure 1:
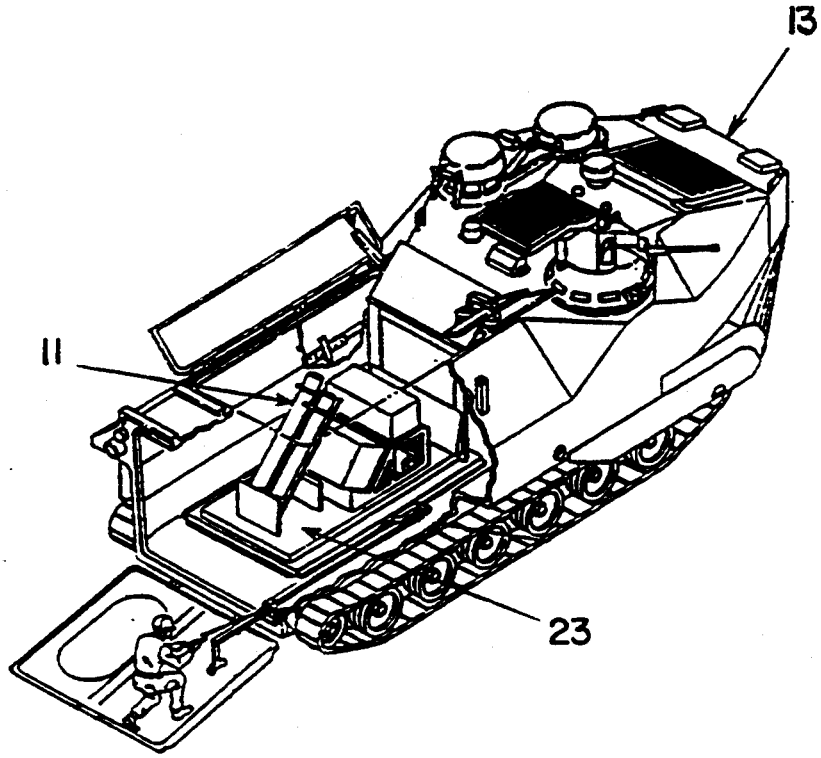
FIG. 1 illustrates a distributed explosives delivery system according to the present invention, mounted in an amphibious assault vehicle with a portion of the equipment bay shown cut away in this view to facilitate viewing of the launch assembly.

Referring now to the drawings, wherein like reference characters designate like or corresponding parts throughout the several views, there is shown in FIG. 1 a distributed explosives delivery system 11 mounted on a U.S. Marine Corps Assault Amphibian Vehicle (AAV) 13. System 11 is a means of reliably deploying and spreading an explosives net such as that under development by the U.S. Navy. AAV 13 is a tracked amphibious assault vehicle. However, system 11 can be mounted on a variety of combat vehicles such as the Landing Craft, Air Cushion (LCAC), barges or causeways. The LCAC can also be described as a hovercraft or a surface effects vehicle. The LCAC is described in J. L. Williams, *The Marines and Tactical Mobility: A Corps on the Move* (U.S. Army War College, Carlisle Barracks, Pa., 5 May 1983) (NTIS Accession No. AD-A128992), which is hereby incorporated by reference herein. Operation of the LCAC is described in *Air Cushion Vehicle Operator Training System (ACVOTS) Task Listing for LCAC Operator* (Naval Training Equipment Center, Orlando, Fla., September 1982) (NTIS Accession No. AD-A221 416), which is also hereby incorporated by reference herein. Other surface effect ships on which system 11 can be employed are described in R. Church, *An Update on SES Design Techniques and Their Application to Repowering the USCG WSES and the USN SES*-200 (David Taylor Research Center, Bethesda, Md., February 1989) (NTIS Accession No. AD-A206 638), presented at the CACTS/USHS 1988 Joint International Conference on Air Cushion Technology, Annapolis, Md., 27-29 Sep. 1988. The Church report is also hereby incorporated by reference herein. Other air cushion vehicles on which the present invention can be employed are described in Z. G. Wachnik, *Air Cushion Vehicles—New Technology in the Navy* (NTIS Accession No. AD-A773 350), reprinted from *Naval Engineers Journal,* August 1973. The Wachnik article is hereby incorporated by reference herein. However, for simplicity, the following description is based on mounting system 11 in AAV 13.

The design of system 11 allows temporary modification of a combat vehicle to perform mine countermeasures (MCM) neutralization missions and then return to other duty. In the following description, system 11 can use previously developed rockets of different diameters and lengths, and the Marine Corps or Navy distributed explosives mine neutralization net to complete the mine neutralization package. Previously developed rockets that can be utilized in the present invention include the Harpoon Booster and the Rocket Assist Take-Off (RATO) Motor developed by Morton Thiokol for McDonnell Douglas Corporation and Northrop Corporation respectively. The line charge delivery rocket currently under development by the U.S. Navy at the Naval Surface Weapons Center, Indian Head Division, can also be so utilized. A relatively small rocket that could be so utilized such as for small breaching situations is the MK22 MOD 4 rocket (produced by Morton Thiokol) which is capable of deploying 3100 pounds of explosive line. A solid-fuel rocket is preferred for ease of deployment, but a liquid-fuel rocket could be used instead. System 11 has two primary subsystems, further described herein. One such subsystem is rocket kit or net delivery rocket assembly 15, illustrated in FIGS. 3 and 4 in its stowed or prelaunch configuration, and illustrated in FIGS. 7–9 in its fully deployed, in flight configuration. Details of rocket kit 15 are illustrated in FIGS. 5, 6 and 10–16. Rocket kit 15 is a cap/sleeve-mounted extension which is installed on a rocket 17 to actually spread the explosives net 19. The other such primary subsystem of system 11 is rocket launcher assembly 21, illustrated in FIGS. 17–26. Launcher assembly 21 includes a pallet 23, launch tubes 25 and 27, mounting hardware and explosives net magazine. Launch tubes 25 and 27 are similar, so that only one launch tube 25 is described in detail for simplicity. The description herein of launch tube 25 also applies to launch tube 27. Rocket kit 15 is a cap/sleeve mounted extension installed on rocket 17 to spread the explosive array 19 after launch. Spreading the explosive array is accomplished by using spring mechanism 31 of FIG. 10 to spread arms 33 and 35 apart, and by using a gas generator cartridge expansion system 109 to extend arms 33 and 35. Rocket launcher assembly 21 includes magazine positioning subassembly 37, launcher lifting subassembly 39, rocket launch tube assembly 41, pallet assembly 23 and array deflector 45. Rocket launcher assembly 21 is capable of separately handling two rockets 17 and 17A, each such rocket delivering a single array.

Rocket kit 15 includes five modules: cap/sleeve assembly 47, rocket slip collar 49, arm extension assembly 51, extension arms 33 and 35, and net tow cables 53 and 55. Rocket kit 15 is also provided with stability cables 57 and 59 which pass through fixed forward collar stop 61 to yoke 63. Yoke 63 is attached to tow cable 65, which is connected to the middle of the front portion of net 19. The stability cables 57 and 59 provide two positive actions on the rocket 17. First, the weight of explosive net 19 is used to partially counteract the tendency of extension arms 33 and 35 to bend after their elongation. Second, stability cables 57 and 59 pull down on the forward portion of rocket 17 to compensate for the downward force caused by tow cables 53 and 55 at the rear of the rocket.

Figures 2, 3:
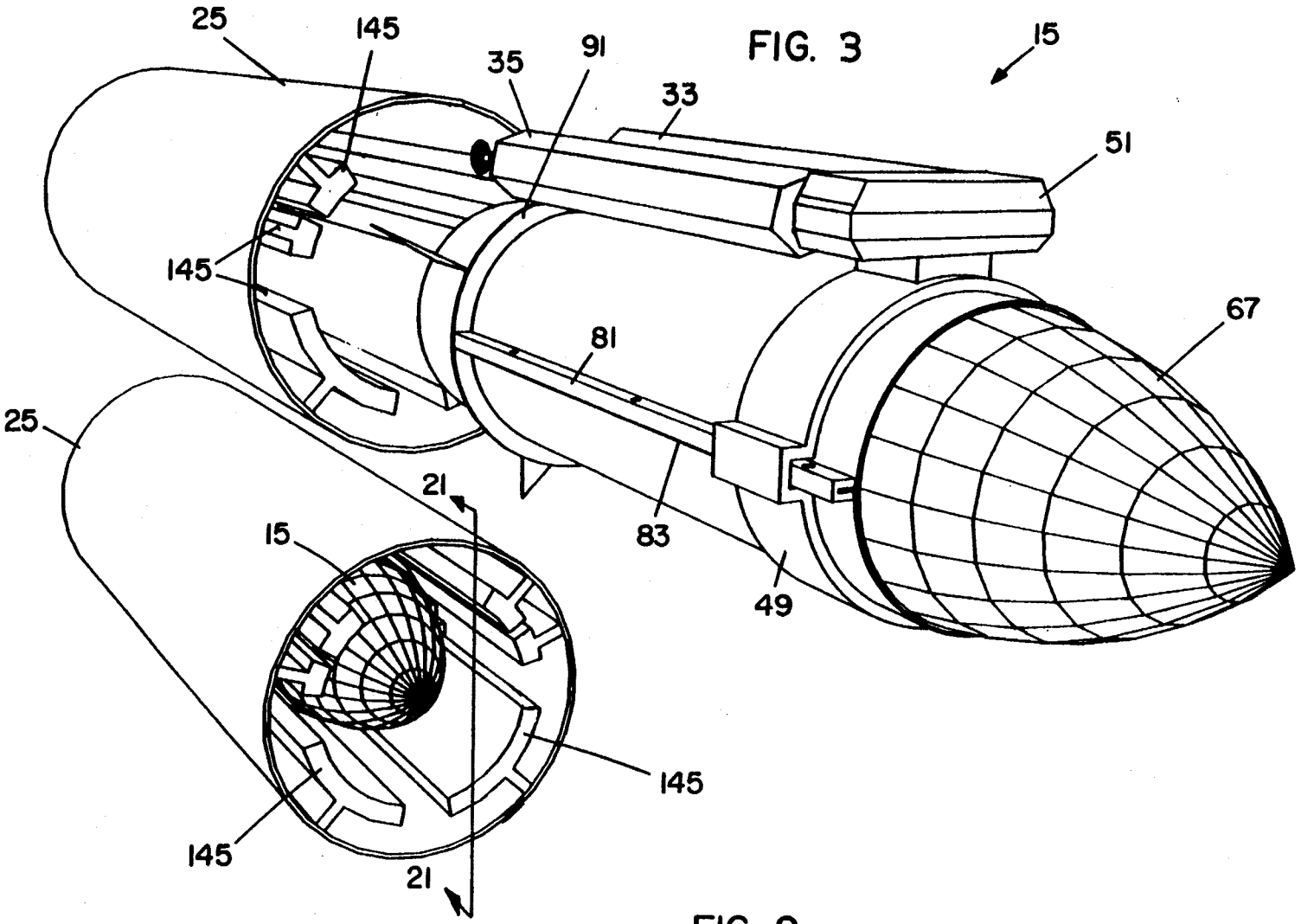
FIG. 2 is a perspective view of a net delivery rocket assembly according to the present invention, shown disposed in one of the launch tubes illustrated in FIG. 1.
FIG. 3 is a perspective view of the net delivery rocket assembly of FIG. 2 shown removed from its launch tube, shown in its stored or pre-launch collapsed configuration but without its clam shell, with a perspective view of the empty launch tube.
Figure 4:
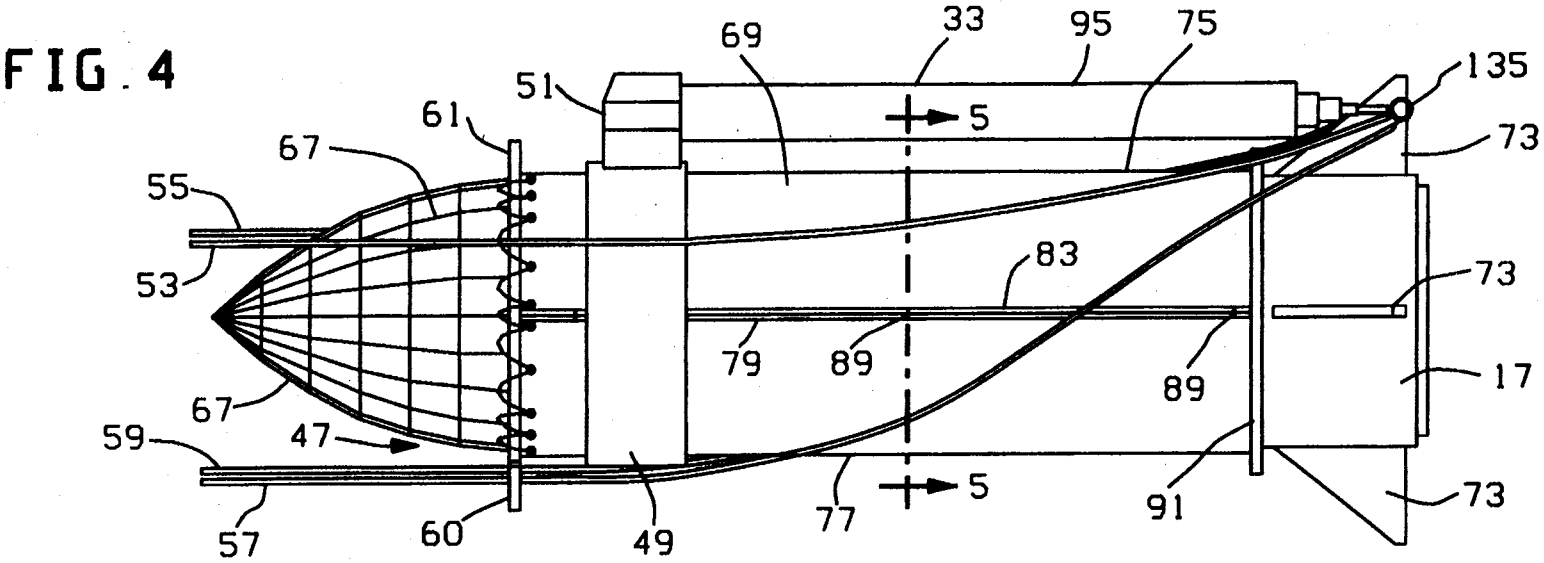
FIG. 4 is a side view of the rocket assembly of FIG. 3.
Figure 6:
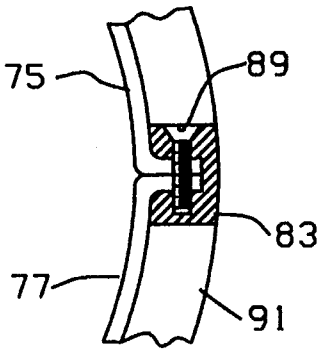
FIG. 6 is an enlarged view of a portion of FIG. 5 showing greater detail.
Figure 5:
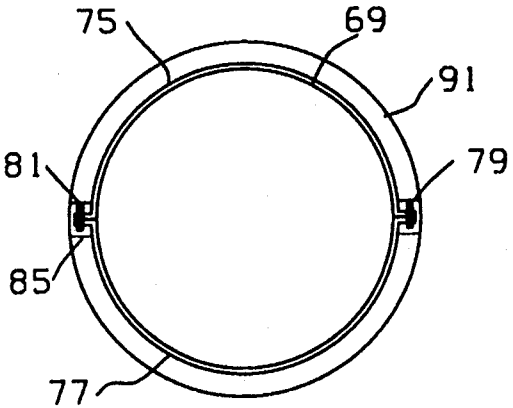
FIG. 5 is a cross-section of the sleeve of FIG. 4 taken along the line 5—5 of FIG. 4.
Figure 7:
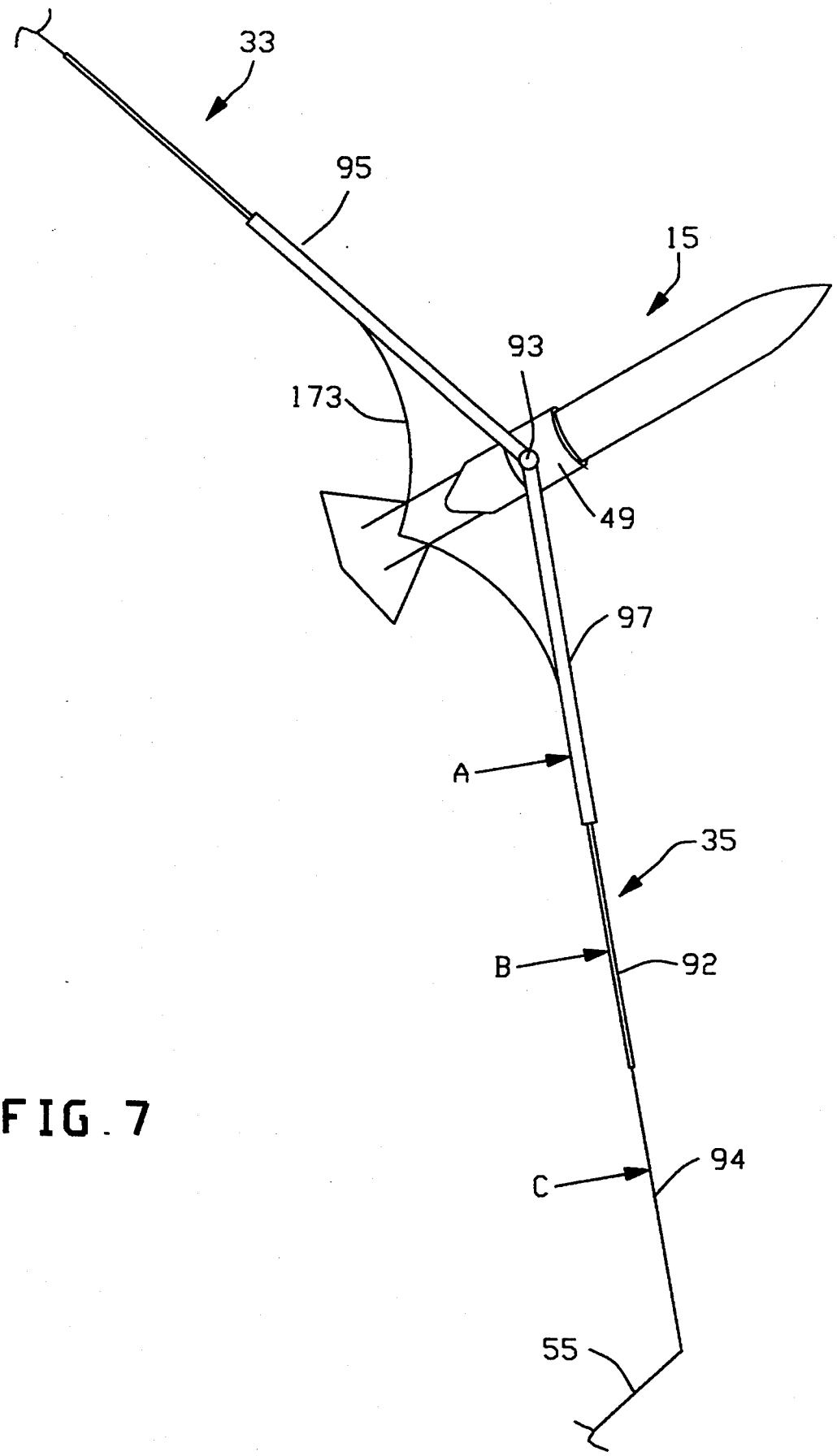
FIG. 7 is a top view of the rocket assembly of FIG. 3 but shown in its fully extended and deployed configuration in flight after launch.
Figure 8:
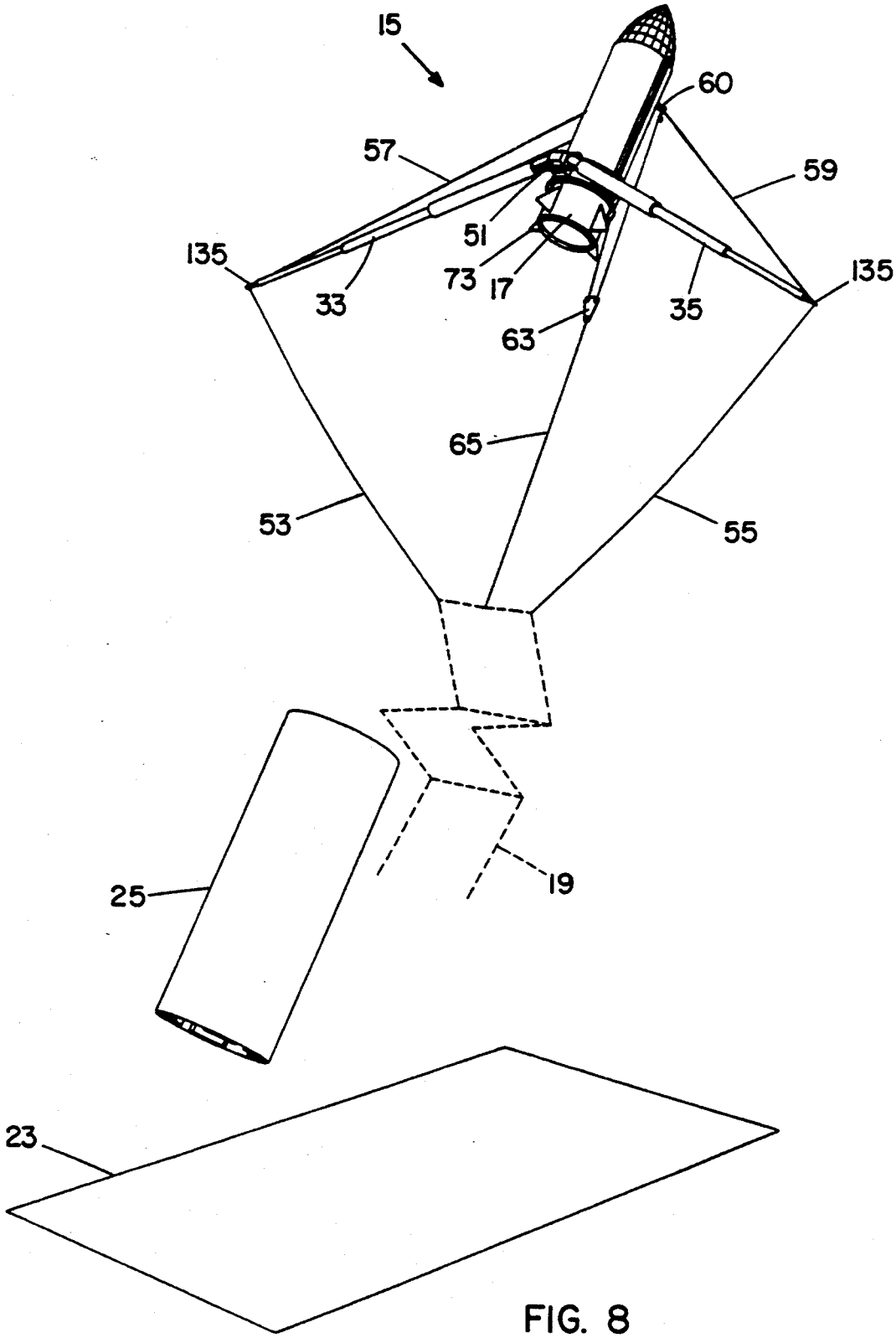
FIG. 8 is a forward view of the rocket assembly of FIG. 7 beginning to deploy a net after leaving its launch tube.
Figure 9:
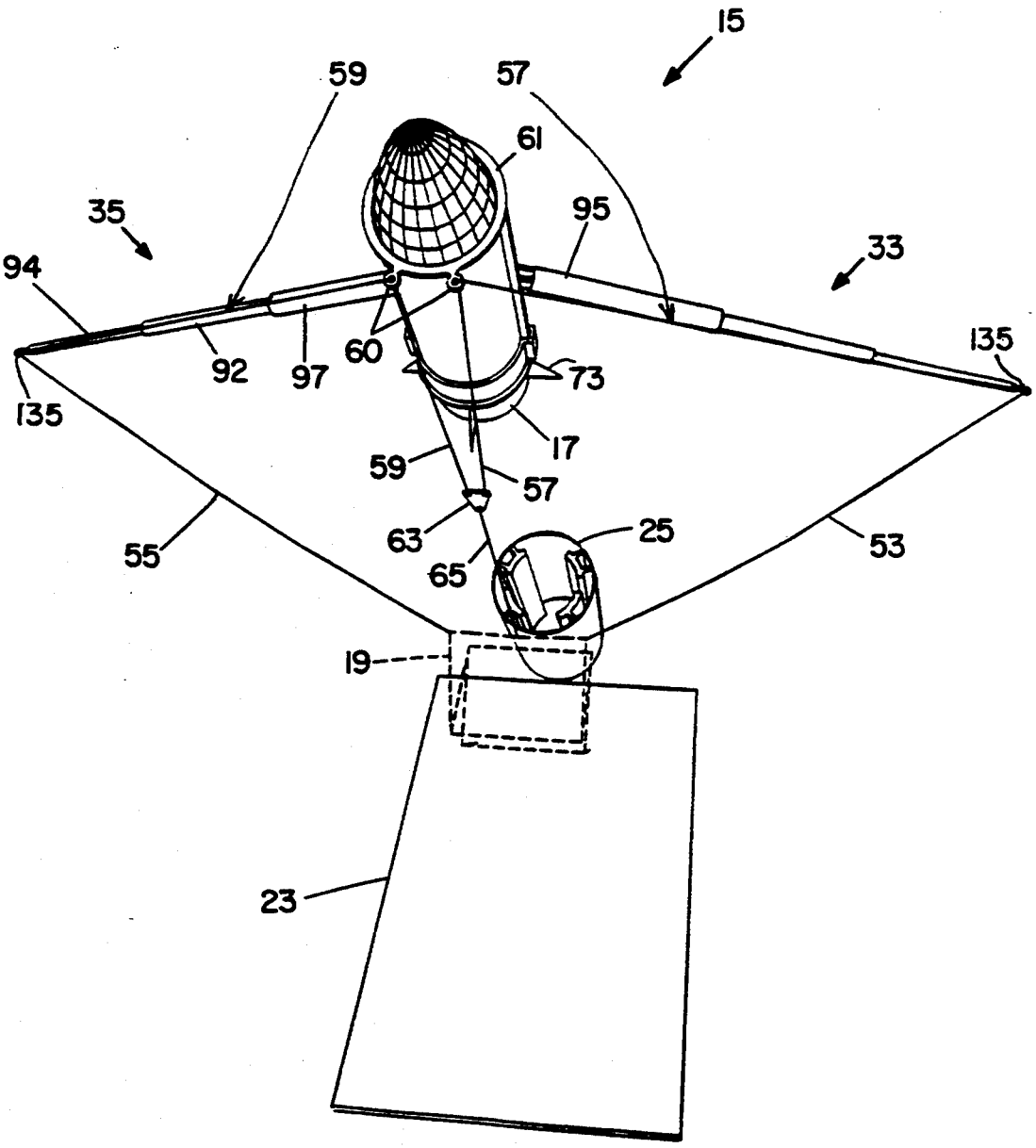
FIG. 9 is a right rear view of the extended configuration of the rocket assembly of FIG. 8, shown at the same stage of operation as in FIG. 8 but in a different view.

The cap/sleeve assembly 47 depicted in FIGS. 3 and 4 provides the physical interface between deployment rocket 17 and the rest of rocket kit 15. Cap 67 is made of a fiber net material and fits tightly over the nose cone of rocket 17. The base of cap 67 is attached to the forward edge of sleeve 69 by a thread material 71 laced through small holes in the perimeter of sleeve 69. Cap 67 reduces strain on the sleeve-to-rocket skin contact during initial rocket firing. The initial impulse of rocket 17 and the consequent setback tendency for sleeve 69 to slide along the rocket skin toward rocket fins 73 is ameliorated by having cap 67 over the rocket nose cone. Sleeve 69 is comprised of two pieces 75, 77 of a lightweight metal which are clamped and/or screwed in place over the outside of the rocket skin. No penetration of rocket 17 is thus required for mounting rocket kit 15 thereon. Sleeve 69 runs along the length of rocket 17 from just behind the rocket nose cone to just before the flight control surfaces (fins 73) of the rocket. Sleeve 69 provides a smooth, slidable surface for slip collar 49 to move from the front of rocket 17 (as shown in FIGS. 3 and 4) while in launch tube 25 to just in front of fins 73 after launch (as shown in FIGS. 7, 8 and 9). A cross section of sleeve 69 is shown in FIGS. 5 and 6. FIG. 5 depicts the two ridges 79 and 81 which protrude from the curved surface of sleeve 69. These two protrusions 79 and 81 as shown in FIG. 5 are the bent metal of sleeve 69 slipped into a respective slotted aluminum bar 83 and 85 and screwed 89 together to complete the encircling of rocket 17 with sleeve 69. These sleeve connection ridges 79 and 81 also serve as stabilizing and orientation ridges (or "lands" in the rifled gun barrel terminology) to keep slip collar 49 from slidably rotating or rolling around the rocket 17 perimeter surface. An aluminum collar stop 91 is attached to the rear of sleeve 69. Collar stop 91 limits the rearward travel of collar 49 along sleeve 69.

Slip collar 49 supports extension arm assembly 51 on rocket 17 as shown in FIGS. 7, 8 and 9. Collar 49 is mounted on sleeve 69 towards the front end of rocket 17 before launch, thereby allowing the collapsed extension arms 33 and 35 to rest parallel to rocket 17 and sleeve 69 inside launch tube 25. With launch of rocket 17, as the rocket leaves launch tube 25, the initial impulse of the rocket pushes the rocket through collar 49 until collar 49 reaches collar stop 91 immediately forward of rocket fin assembly 73. Collar 49 initially is held in place by both its inertia, and a set of clips at or near the front or forward end of sleeve 69. Each such clip for slip collar 49 is a single sided clip equivalent to half of a clip 103 of FIG. 25. These clips are mounted on the forward collar stop 61 of sleeve 69, and provide a friction interface to the slip collar 49. Slip collar 49 is milled to accept the two orientation ridges 79 and 81 on sleeve 69, and to slide thereon and on sleeve 69. In addition to the basic function of providing a physical interface between arm extension assembly 51 and cap/sleeve assembly 47, slip collar 49 improves the efficiency of tube launch by acting as a semi-active sabot.

Figure 10:
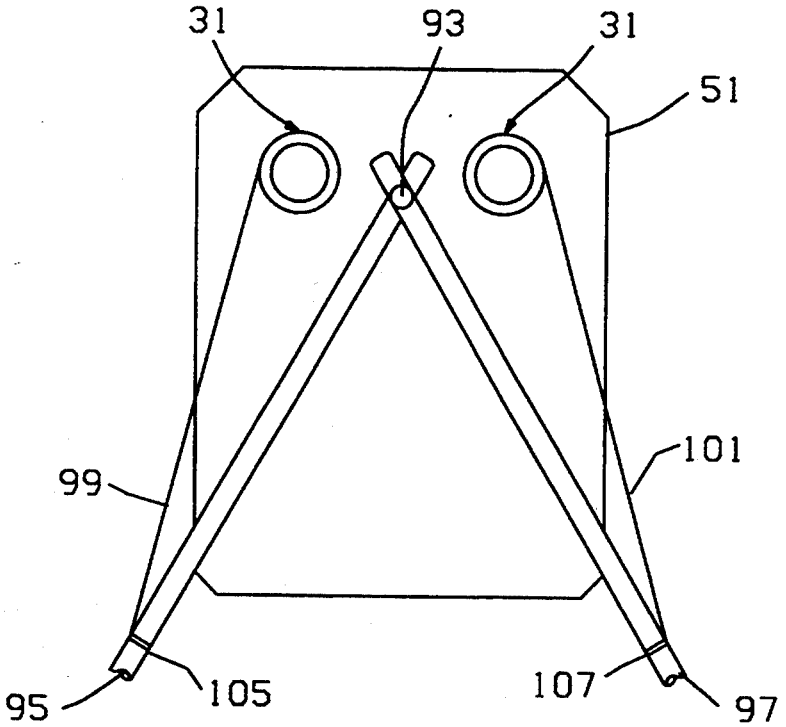
FIG. 10 illustrates a portion of the rocket arm extension assembly of FIGS. 3 and 9 in greater detail in an enlarged view with its cover removed.
Figure 35:
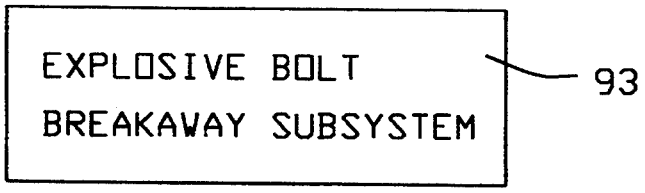
FIG. 35 is a diagrammatic representation of an explosive bolt, breakaway subsystem.
Figure 37:
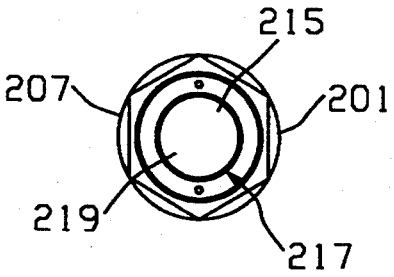
FIG. 37 is a top view of the bolt of FIG. 36.
Figure 36:
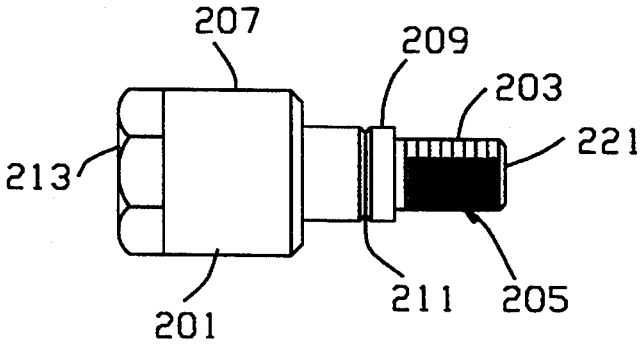
FIG. 36 is a side view of one example of a bolt that can be utilized as part of the apparatus of FIGS. 7, 10 and 34.

Arm extension assembly 51 is mounted on slip collar 49 and supports pivot 93 and expansion spring mechanism 31 for extension arms 33 and 35. Arm extension assembly 51 also provides the physical support for the gas elongation charge battery and switch. Pivot 93 is a machine bolt which passes through a hole near the end of the first section 95 and 97 (also identified as Section A) of each extension arm 33 and 35 respectively, and threads into the top of slip collar 49 as shown in FIGS. 7 and 10. This machine bolt is part of an explosive bolt, breakaway subsystem such as those provided by Hi-Shear Technology Corporation, Torrance, Calif. A simplified diagrammatic representation of an explosive bolt breakaway subsystem is shown in FIG. 35. One example of a bolt that can be utilized as pivot 93 is illustrated in FIGS. 36 and 37. Bolt 201 of FIGS. 36 and 37 includes a narrower portion 203 with threads 205 extending from one end 221, a wider portion 207 at the opposite end of the bolt, and an intermediate portion 209 disposed between portions 203 and 207. Intermediate portion 209 has a diameter or cross-sectional width intermediate that of portions 203 and 207. Intermediate portion 209 is provided with a circumferential or perimetrical groove 211 defining a shear plane at which bolt 201 is most likely to shear. Extending inwardly in bolt 201 from its head or end 213 opposite threads 205 is an opening 215 threaded 217 to accommodate an explosive cartridge 219. Activation of cartridge 219 causes bolt 201 to shear at groove 211. Use of a single explosive bolt as pivot 93 frees both extension arms 33 and 35 simultaneously even under tactical conditions, and is more reliable than using two explosive tension rod separators.

Expansion spring mechanism 31 is a combination of four extension springs, two attached to the leading edge of each inboard section 95 and 97 of extension arms 33 and 35 respectively. As shown in FIG. 10, in spring mechanism 31, two extension springs 99 and 101 are attached from the arm expansion assembly 51 to the leading edge of the (inboard) first section 95 and 97 of each arm (also identified as Section A of the arms). Springs 99 and 101 each are two tandem extension springs which uncoil as arms 33 and 35 are swung alongside the rocket 17 fuselage for insertion into launch tube 25. When after launch, extension springs 33 and 35 clear launch tube 25, springs 99 and 101 coil up to swing the extension arms into place. Springs 99 and 101 can for example each be two stainless steel NEG'A-TOR constant force extension springs, Part No. SH31UV8, available from AMETEK, Inc. Although only two springs 99 and 101 are illustrated in FIG. 10, if the AMETEK spring referred to above is used, then each of springs 99 and 101 should have two such AMETEK springs, used in tandem. Each spring 99 and 101 is connected to a respective extension arm section 95 and 97 with a respective spring connection band 105 and 107.

Figure 27:
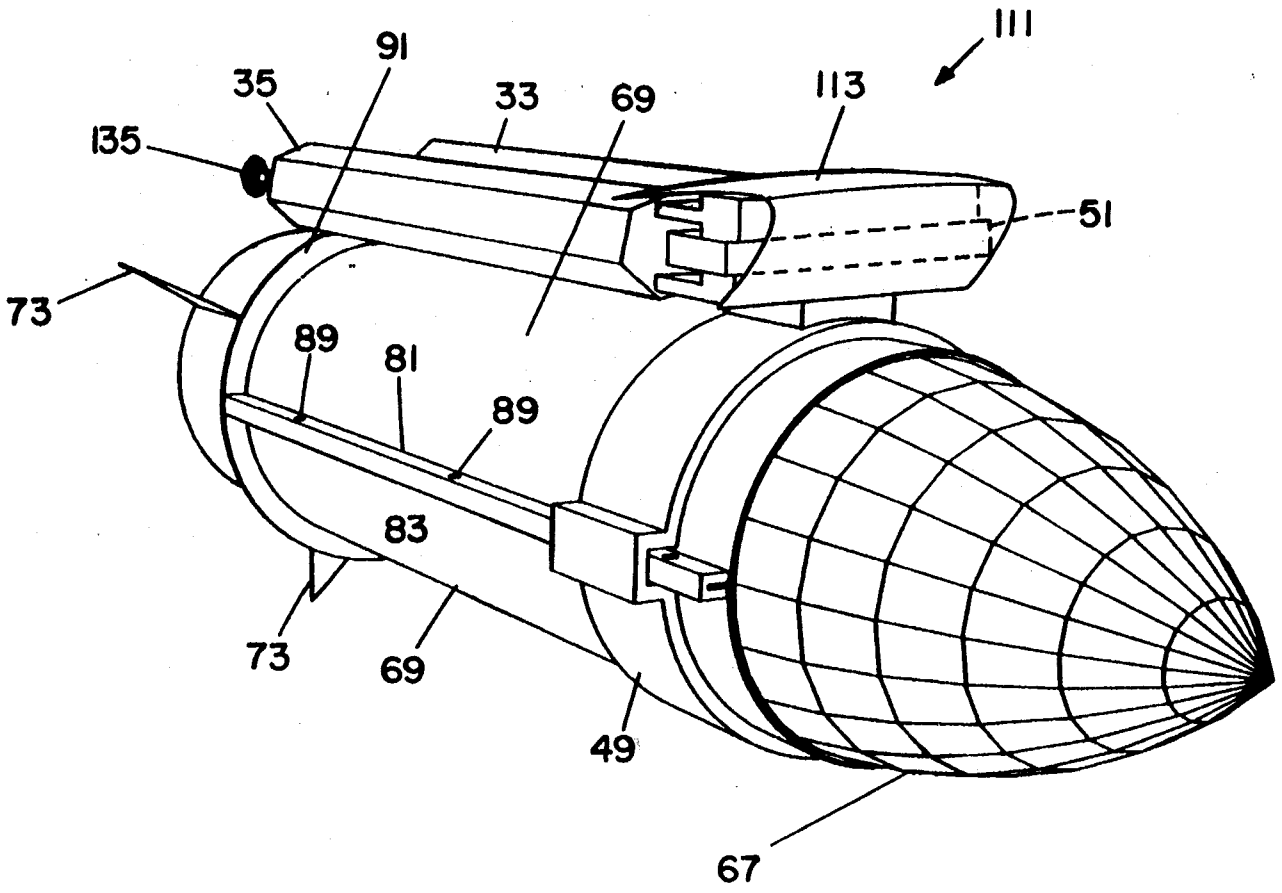
FIG. 27 is a perspective view of the net delivery rocket assembly of FIG. 2 without its launch tube, shown in its stored or pre-launch collapsed configuration but with its clam shell.

As shown in FIG. 27, extension arms 33 and 35 rest between two pieces 113 and 115 of spring steel, together called a ramp catch clam shell 111. The bottom piece of spring steel 115 has a slip ramp catch and two stamped recesses defined by ridge 117, each having a width that is one-third the diameter of one of first sections 95 and 97, to hold the arms in place after swinging the arms into the spread or extended position. Pieces 113 and 115 can alternatively each be semi-circular instead of the shapes shown in the Figures. A semi-circular bottom piece has a slip ramp catch and two stamped recesses. However, a rectangular clam shell is preferred, for easier mounting. In the fully extended position, each of sections 95 and 97 snaps into the recess on its side of bottom piece 115 to retain the extension arm spread position during flight. Clam shell 111 thus locks the arms into position after the arms have moved to the spread position.

Figure 11:
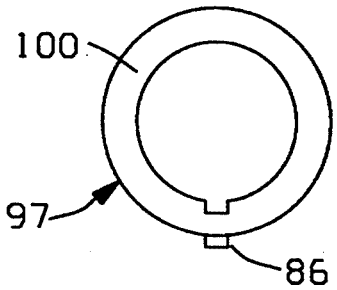
FIG. 11 is a cross-section of the inboard extension arm section of FIGS. 7–9.
Figure 12:
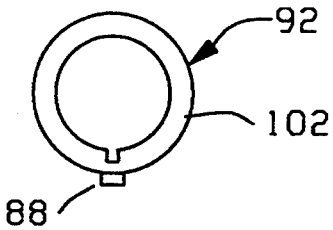
FIG. 12 is a cross-section of the middle extension arm section of the rocket assembly of FIGS. 7–9.
Figure 13:
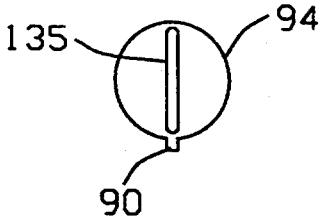
FIG. 13 is an end view of the outboard extension arm section of the rocket assembly of FIGS. 7–9.

There are two extension arms 33 and 35 connected to extension arm assembly 51. Each extension arm 33 and 35 has three concentric arm sections, a gas generator connection, and a tow cable connecting loop. Each arm section has a stiffening ridge 86, 88, 90 to reduce bending effects after extension. A cross-section of each of the arm sections is depicted in FIGS. 11–13 respectively. Arms 33 and 35 are similarly constructed. FIGS. 11–15 apply to both arm 33 and arm 35, so only one arm is illustrated in those figures for convenience and simplicity. Each of the middle 92 and small end 94 arm sections (Sections B and C) have a steel grommet as an extension stop 96 or 98 to prevent that arm section from disconnecting from the larger arm section during arm extension. Additionally, Sections 95, 97 and 92 (Sections A and B) have end caps 100, 102 which have holes of sufficient diameter to permit the next small arm section to pass through, but prevent the steel grommet extension stop from passing through. FIG. 15 shows a longitudinal cut-away of the extension arm sections to detail the steel grommet extension stops and the threaded end caps as they are mounted on the arm sections. The largest diameter arm section 95, 97 (Section A) is pivoted 93 at the arm extension assembly 51, and its interior connects to gas generator 109 in the arm extension assembly. The hollow interior of each middle arm section 92 communicates with the hollow interior of the next larger arm section to receive gas for arm extension.

Figure 28:
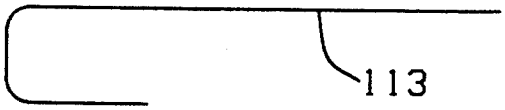
FIG. 28 is a side view of the upper piece of the clam shell of FIG. 27.
Figure 29:
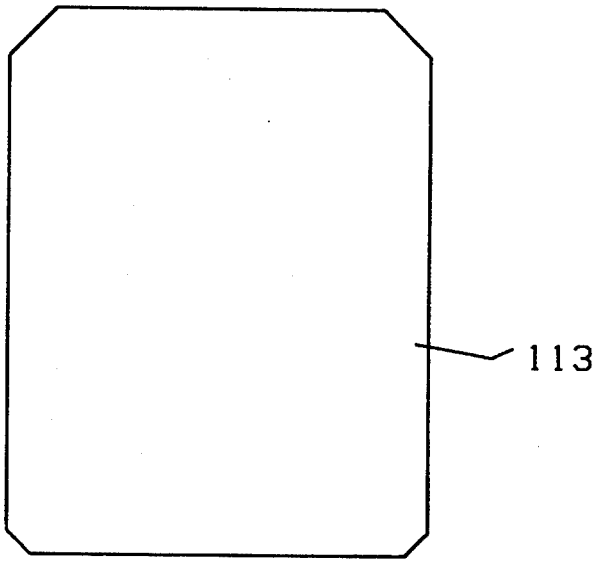
FIG. 29 is a top view of the upper piece of FIG. 28.
Figure 30:
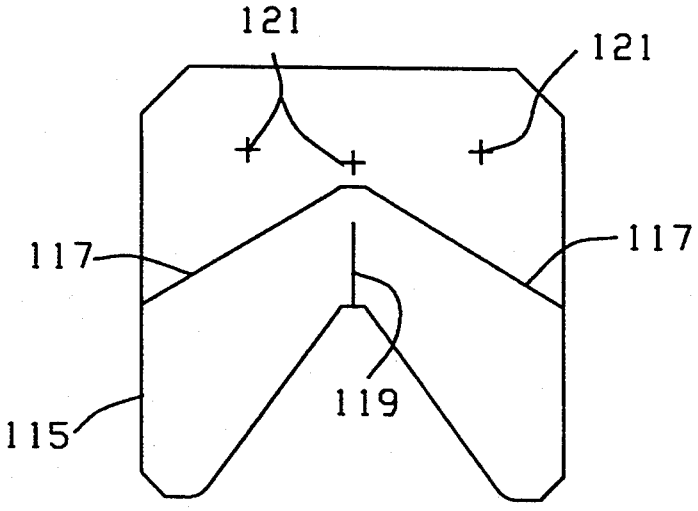
FIG. 30 is a top view of the lower piece of the clam shell.
Figure 31:
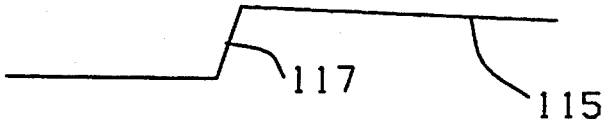
FIG. 31 is a side view of the lower piece of FIG. 30.
Figure 32:
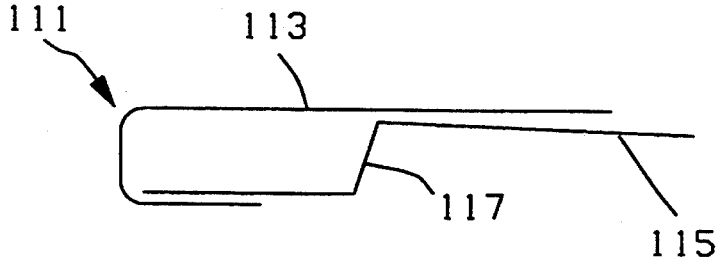
FIG. 32 is a side view of the assembled clam shell.

As shown in FIG. 27, clam shell 111 is mounted on slip collar 49. FIG. 27 is a perspective view of rocket kit 15 showing the upper portion 113 of clam shell 111, with hidden lines showing the arm expansion assembly 51 body on slip collar 49. Details of clam shell 111 are illustrated in FIGS. 28–32. FIG. 28 is a side view of top piece 113 of clam shell 111. FIG. 29 is a top view of top piece 113 of clam shell 111. FIG. 30 is a top view of bottom piece 115 of clam shell 111. FIG. 31 is a side view of bottom piece 115 of clam shell 111. As shown in FIGS. 30 and 31, bottom piece 115 is provided with a bent/raised ridge 117, a slit 119 and a plurality of holes 121 for bolts to connect bottom piece 115 to collar 49. FIG. 32 is a side view of the assembled clam shell 111 including top piece 113 and bottom piece 115.

Figure 33:
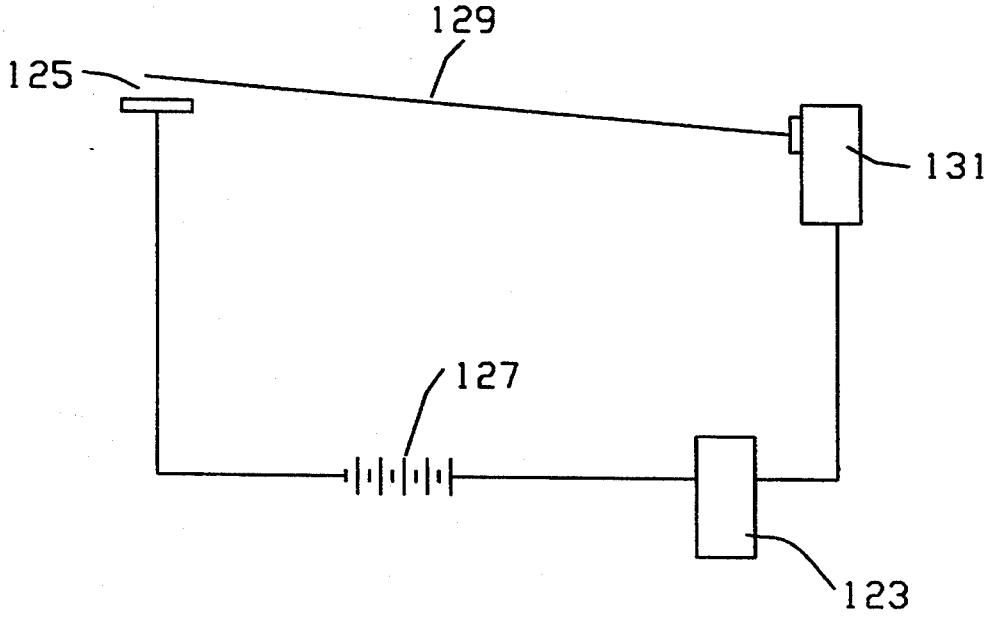
FIG. 33 is a schematic diagram of electric circuitry for a gas generator included in the net delivery rocket assembly of FIGS. 2–4 and 27.

Gas generator 109 is made of an electrically activated low explosive gas generator cartridge such as is available from Hi-Shear Corporation that extends arms 33 and 35 as though they were cylinder pistons. Gas generator 109 is made of an electrically released plunger or firing pin 123 and a low explosive percussion charge, such as the PPC-14 gas generator cartridge produced by Hi-Shear Corporation. Gas generator 109 produces sufficient gas pressure to fill the four concentric sections (two in each arm 33 and 35) of the expansion arms to extend the expansion arms to full length. Electric circuitry for gas generator 109 is illustrated in FIG. 33. The gas generator connector is a two position (open or closed) switch and electrical terminal 125 which is connected to a battery 127. It is preferred to have a small gap between the two parts of switch 125, but the size of this gap is exaggerated in FIG. 33 for a clearer view. Switch 125 closes when arms 33 and 35 spread to the extended position, due to compressive spring force as described above, so that the arms swing across the switch. The position of the switch contacts on the extension arms 33 and 35 and on the slip collar 49 delays the activation of the gas generator charge until the arms are in the fully spread position. Then the expanding gas can force the arm sections into a fully elongated state or position.

The switch to activate the low explosive gas generator (such as Hi-Shear PPC-14) is actually comprised of each section A (sections 95 and 97) of extension arms 33 and 35, and contacts on the body of arm extension assembly 51. The switch action is accomplished by a copper strip 129 emplaced on the bottom surface of the A section or inboard section 95 and 97 of each arm 33 and 35 and electrically connected to a copper split ring 131. Split ring 131 passes around the machine bolt of pivot 93 which holds the A sections to the arm extension assembly 51 body. This split ring 131 is wired to the electrically detonated plunger firing pin 123 which activates the gas generator 109. The extension arm A Section acts as the through-arm of the switch with a contact material embedded on its lower surface. The other portion of the switch is a contact which is in the top surface of the portion of the extension arm assembly on which the clam shell is mounted. This is an interior surface because the top of the clam shell is the top-most portion of the extension arm assembly on the slip collar. This other contact is connected to battery 127, and the battery is connected to firing pin 123. When extension arms 33 and 35 separate and spread apart in flight due to spring mechanism 31 action, the arms (and hence the conducting copper strips) move across this surface of the arm extension assembly 51 body and make contact with the copper contacts on that surface. This completes the circuit and releases firing pin 123. The arms take approximately 1.5 seconds to spread under load and then serve to close the switch. The electrically released firing pin has a 1 second delay. This timing ensures that the tow cables are fully uncoiled at the time the arms are filled with gas, and yet before full tension exists on the arms. The timing of the delay in the firing pin can be adjusted to meet the specific net and rocket combination requirements for deployment.

Figure 34:
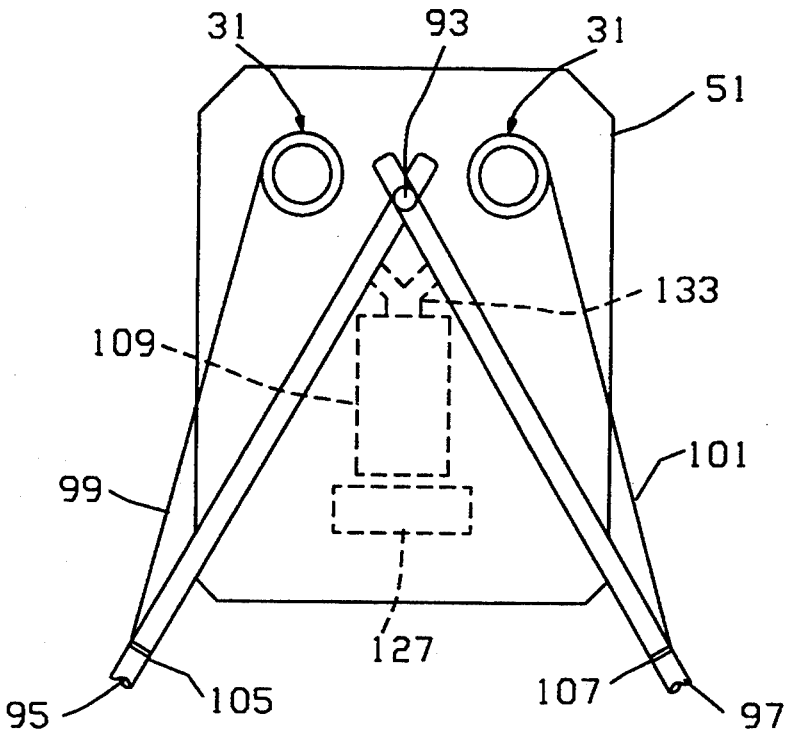
FIG. 34 shows layout of the gas generator.

Gas generator 109 is disposed inside the body of assembly 51 and is attached to a flexible fiber-rubber manifold 133 that feeds generated gas into the end of each A section 95 and 97 of arms 33 and 35 approximately 1.5 inches behind pivot 93 that passes through the A sections. This ensures that no gas escapes through the space between the bolt 93 and the resin of the section A 95, 97. The first few inches of each section A 95 and 97 are solid to provide the support for the machine bolt of pivot 93 and area for the manifold interface. The location of generator 109, battery 127 and manifold 133 in assembly 51 is illustrated in FIG. 34.

As shown in FIGS. 8 and 9, there is a set of stability cables 57 and 59 which run from the tip of the extended arms 33 and 35 through eyelets 60 on collar stop 61 mounted forward on sleeve 69. This set of stability cables 57 and 59 then join at a yoke 63 which is attached by tow cable 65 to the center of the front of explosive array 19. Stability cables 57 and 59 provide some countervailing force to the tension caused by the tow cables 53 and 55 and the weight of explosive array 19. Additionally, the use of three connecting points to array 19 lessens the dip in net 19 during flight and offers a force on the front of rocket 17 to counteract the pitch induced by the tow cables 53 and 55 at the rear of the rocket.

Figure 25:
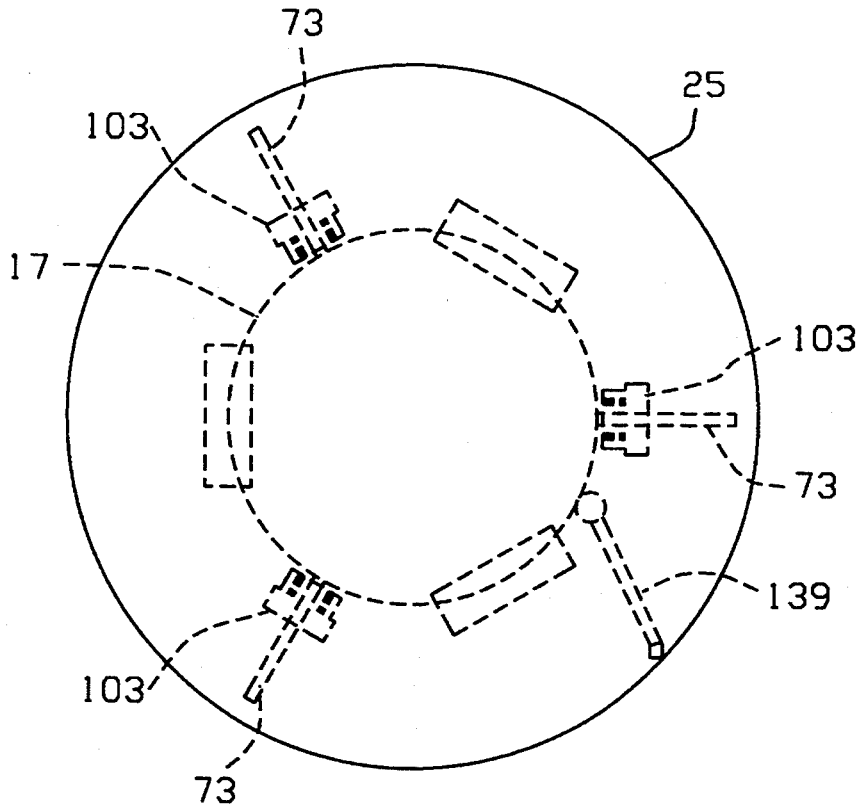
FIG. 25 is a rear end view of the launch tube of FIGS. 1–3 and 21 showing the rocket tube interface clip and connector, with three portions thereof cut away and a portion of the rocket assembly disposed therein shown ghosted for a rear end view thereof.
Figure 26:
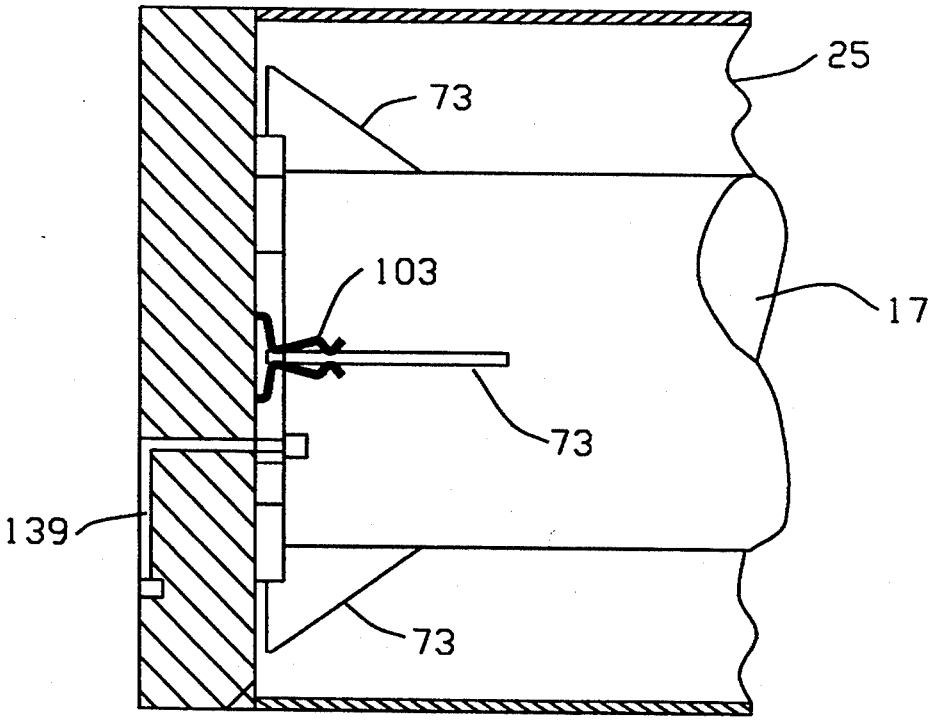
FIG. 26 is a longitudinal section of the launch tube of FIGS. 1–3, 21 and 25 and a side view of a rear portion of the rocket of FIGS. 2–4 disposed therein, showing the launch tube interface clip and connector of FIG. 25 in a different view.

The rocket tube clip interface, illustrated in FIGS. 25 and 26, is at the base of rocket tube 25 and provides a physical point of stability for the nozzle of the rocket. This stability restrains the rocket 17, prior to firing, from sliding on rocket tube 25 such as under rough sea conditions. The rocket tube clip interface also provides the electrical connection (via electrical conduit 139) to the rocket motor ignitor/detonator which is an integral part of the deployment rocket 17. Additionally, a timing signal is transferred, through conduit 139, from a fire control subsystem to the fuzing section of the rocket. This timing signal sets the time after launch at which net 19 must be released from rocket 17. Range is controlled with the fixed tube rocket launcher 25 by releasing the rocket from the net at the appropriate time. The rocket fuzing section denotates one explosive squib to cut the extension arm pivot pin 93 where it attaches to slip collar 49. This action will release net 19 from rocket 17.

Figure 14:
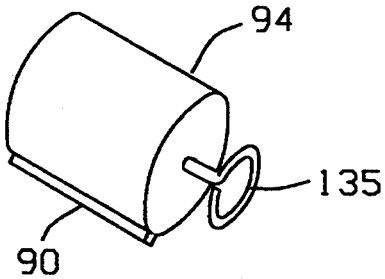
FIG. 14 illustrates a distal or end portion of the extension arm section of FIG. 13, showing in greater detail the connecting loop connected to the end of that section for connecting a tow cable of FIGS. 7–9 to the extension arm section of FIG. 13.
Figure 15:
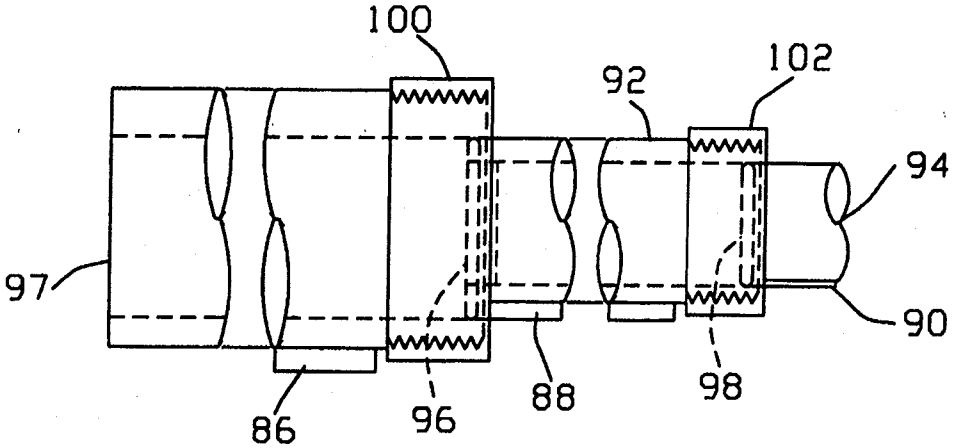
FIG. 15 is a detail of the extension arm sections of FIGS. 7–9 and 11–13 in a longitudinal cut-away view with portions removed for a simplified illustration.
Figure 16:
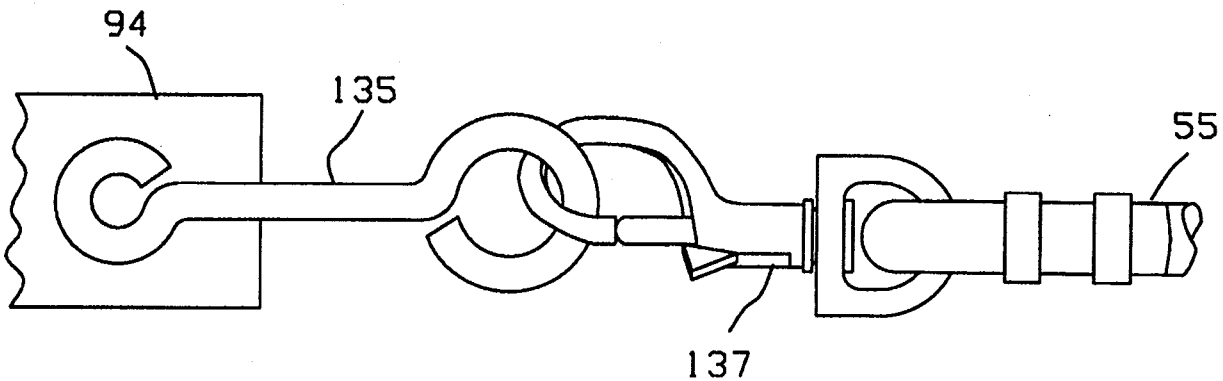
FIG. 16 illustrates apparatus for connecting the extension arm of FIGS. 13 and 14 to a tow cable of FIGS. 7–9, showing a tow cable connecting loop mounted in an extension arm end section.
Figure 17:
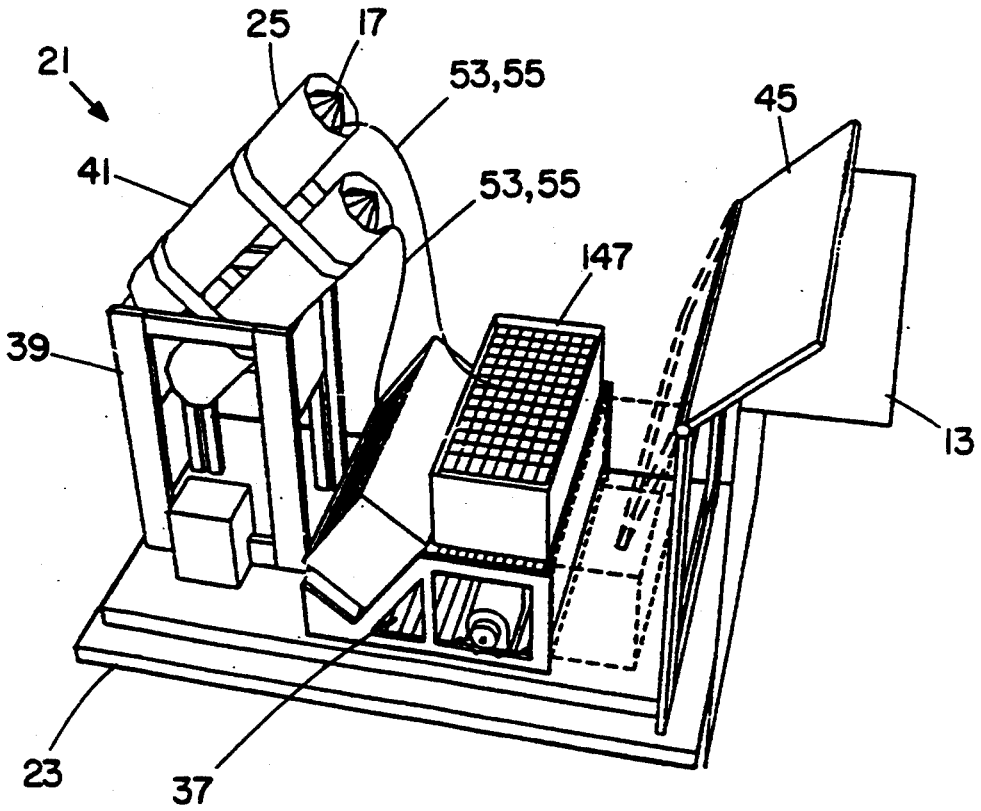
FIG. 17 illustrates the rocket launcher assembly of FIG. 1 in greater detail.

Tow cable connecting loop 135 illustrated in FIGS. 13, 14, and 16 is a $\frac{1}{4}$ inch diameter metal (preferably aluminum) rod which has been shaped to form a loop ($\frac{1}{2}$ inch diameter interior open area) on one end and a second loop ($\frac{3}{4}$ inch diameter interior open area) on the other end with a straight, two inch connecting shaft. Two loops 135 are included in rocket kit 15, with a loop being provided at the distal or outboard tip of each extension arm 33 and 35. As shown in FIG. 16, each tow cable 53 and 55 has a steel snap-clasp 137 with swivel which attaches onto the larger loop; the composite fiber of the end section 94 (section C) of each extension arm passes through the smaller ($\frac{1}{2}$ inch) loop during manufacture of the arm end section 94. The composite fiber will have a resin or plastic material cast with it as part of this physical connection between loop 135 and the extension arm end section 94. Fiberglass or carbon fibers could be used to reinforce the plastic end section 94 prior to casting for the end section. FIG. 16 shows details of the tow cable connecting loop 135 cast into the solid extension arm end section 94.

A webbed folding parasail 173 can be added to rocket kit 15 to help control any tendency of rocket 17 to rotate during flight and to provide some lift at the aft of the rocket. However, inclusion of such a parasail is not preferred because it was found to contribute little lift, and in one instance fouled when the rocket left the launch tube. The webbed parasail, made of light weight rip-stop nylon cloth, is attached to inboard sections 95 and 97 of both extension arms. The parasail is flat except as air lift curves the deployed cloth to form a small airfoil. This permits collapsing of the parasail for stowage in the rocket tube. Attachment is accomplished with plastic cord that runs around the extension arm and through a series of six grommets in the parasail fabric. Additionally, there is one screw-eye in the leading edge of each inboard section 95 and 97 to prevent misalignment of the parasail fabric relative to the slip collar assembly 49. The outermost grommet on each end of the parasail is attached to the screw-eye on the extension arm section 95, 97. There is one plastic cord that runs along the center of the fabric (hence the webbed feature which lends some rigidity) and on the perimeter of the fabric to provide some stiffening. The fabric is folded over and double stitched around each cord so that the cords are, in effect, within a flat fell seam (i.e. the reinforced seams typically used to hold denim jeans together).

Figure 21:
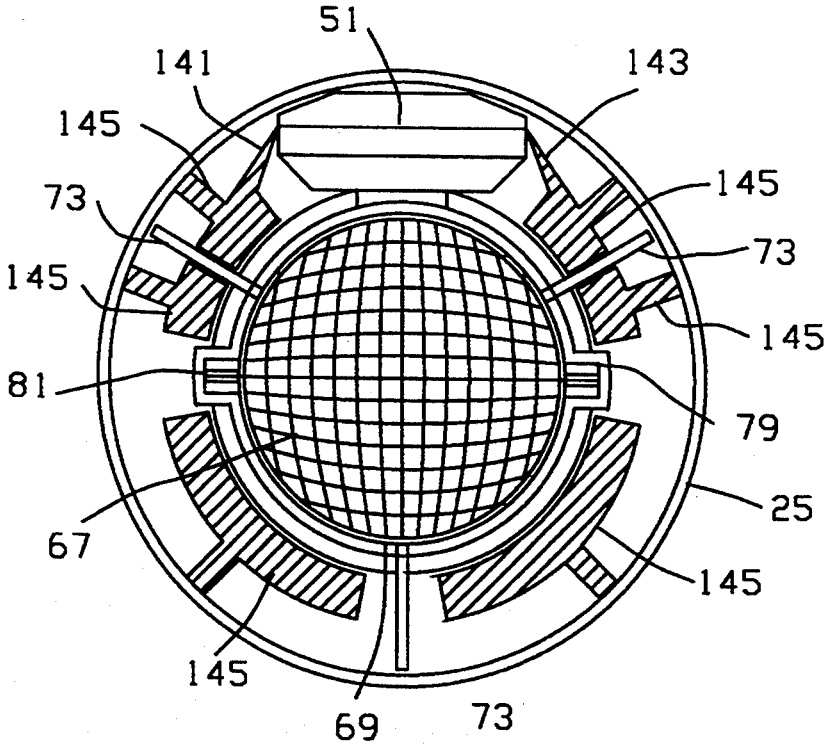
FIG. 21 is a section of FIG. 2 taken along the line 21—21, showing a launch tube of FIGS. 1–3 and 17–20 in a cross-section and a front end view of the collapsed or stowed rocket assembly of FIGS. 2–4.

There is one net tow cable attached to the free or outboard end of each extension arm. The connection is made through a loop 135 mounted in the end of the extension arm, as described above and illustrated in FIGS. 13, 14 and 16. The other end of each tow cable 55 and 57 is attached to a respective front corner of the distributed explosives net 19. Distributed explosives net 19 could for example be the DEMNS for breaching a mine field on land or the beach, or the Navy distributed explosives net also known as an explosive linear array. As shown in FIG. 21, the interior of rocket tube 25 has two cable guides 141 and 143 on the upper set of rocket guides 145. The tow cables 53 and 55 each pass through a respective cable guide 141 and 143 that keep the tow cables from fouling during net 19 deployment. The distributed explosives net 19 is folded and placed in an explosives chest 147 with a sealed cover. This sealed cover is aluminum with a ceramic, heat resistant coating. The cover has two small holes which allow the tow cables 53 and 55 to pass through. The cover is torn open by the tow cables 53 and 55 as they are drawn tight when the deployment rocket 17 leaves the rocket tube 25 and the extension arms 33 and 35 swing open and lock into place. The tow cables 53 and 55 are made of a high strength, non-metallic fiber rated with a tensile strength of one half the net 19 weight. The tow cables 53 and 55 are made of a high strength non-metallic cord, such as standard military nylon cable 7/16 inches in diameter with a tensile strength of 7,000 pounds. The exact diameter and tensile strength required is dependent on the particular flexible array being delivered by rocket 17 and rocket kit 15.

Rocket kit 15 solves the problem of spreading the net and attachment to an existing rocket without requiring structural modification of the rocket itself. The fiber cap 67 over the nose cone of the rocket overcomes inertial setback forces which might otherwise permit mis-mounting of sleeve 69 on the rocket skin. Additionally, the slip collar 49 allows the extension arms 33 and 35 to fit inside the rocket tube 25 prior to launch, and yet have the extension arms at the rear of the rocket for flight stability after launch. The orientation ridges 79 and 81 keep the extension arms 33 and 35 from sliding around the rocket surface and entangling the net 19 during flight. The spring-loaded arm extension assembly provides a reliable mechanism for releasing the extension arms 33 and 35 once they have cleared rocket tube 25. The spring-loaded arm extension assembly uses compressed springs 99 and 101 as a reliable mechanism for releasing (spreading) the extension arms 33 and 35 once they have cleared the rocket tube 25. The mechanism 51 then activates the gas generator 109 and lengthens the arms 33 and 35 to their full extent. The present invention provides an effective method for delivering an explosives net accurately and reliably onto the target area. The present invention eliminates the problems of dual rocket firing to spread the net. There is no time to release mechanism needed for spreading the extension arms, nor for lengthening them. Instead, the spring-loaded arm extension assembly uses compressed springs as a simplified mechanism for releasing (spreading) the extension arms once they have cleared the rocket tube, and means are provided for extending the arms automatically once they have been or are being spread. This improves the probability of successful delivery of the explosives net. A single rocket motor can be used with the modification kit and extension arms to spread the net and place it on the target.

Primary elements of rocket launcher assembly 21 include magazine positioning subassembly 37, launcher lifting subassembly 39, rocket launch tube assembly 41, pallet assembly 23 with rails 43, and net deflector 45. Although as illustrated two rockets and two distributed explosives nets are handled by rocket launcher assembly 21, only one net is delivered at a time.

Figure 18:
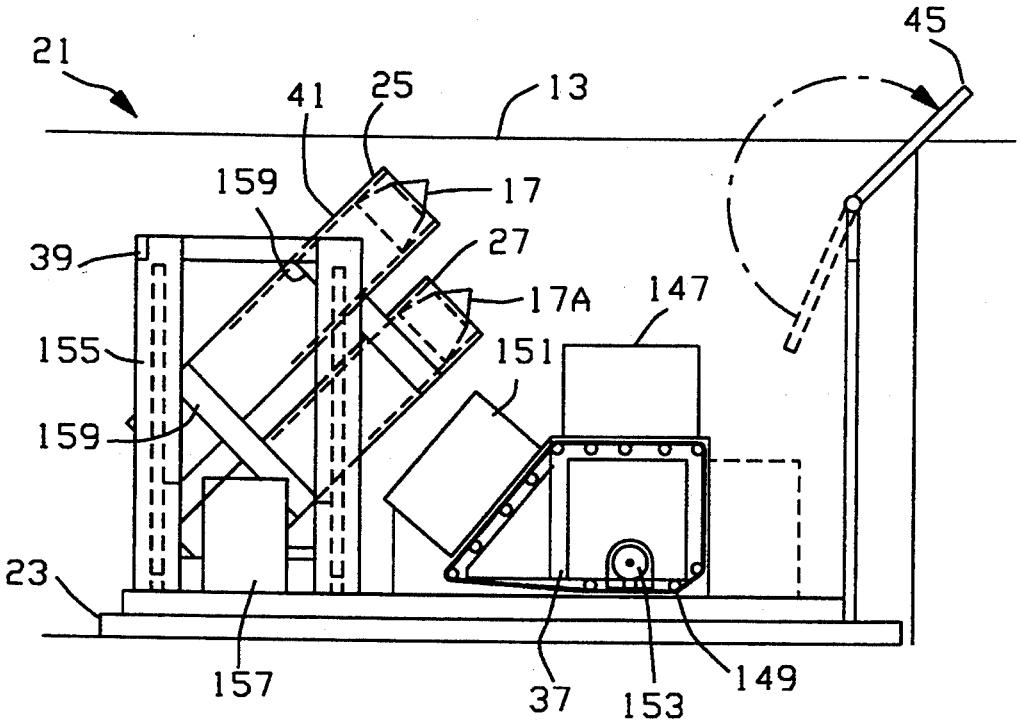
FIG. 18 is a side elevation view of the rocket launcher assembly of FIGS. 1 and 17 including ghosted views showing positions of two portions thereof in different stages of operation.

Magazine positioning subassembly 37 consists of a support frame and conveyor 149, two explosives chests 147 and 151, and a motor/gear assembly 153. FIG. 18 depicts an elevation view of rocket launcher assembly 21. Its purpose is to provide support to the explosives chests 147 and 151, and a physical interface for bolting the motor/gear assembly 153 into position. Additionally, conveyor 149 positions one explosives chest 147 on top for firing, and then rotates forward when the first net has been deployed. This permits the second explosives chest 151 to be positioned on top for delivery. The explosives chests 147 and 151 are aluminum boxes without lids into which removable fiber box inserts are placed. A net 19 is actually stored in each such fiber insert. The fiber inserts are disposable containers that have the nets in them, so that the explosives chests are reusable. Each explosives chest 147 and 151 is not sealed, but the inserts are sealed with an aluminum sealing cover that has a heat-resistant ceramic coating. The tow cables 53 and 55 for the explosives net 19 in each insert pass through the center of the sealing cover and tear the cover away during launch. The gear/motor assembly 153 is controlled from a console, and rotates conveyor 149 to position the explosives chests 147 and 151 as required.

Figure 19:
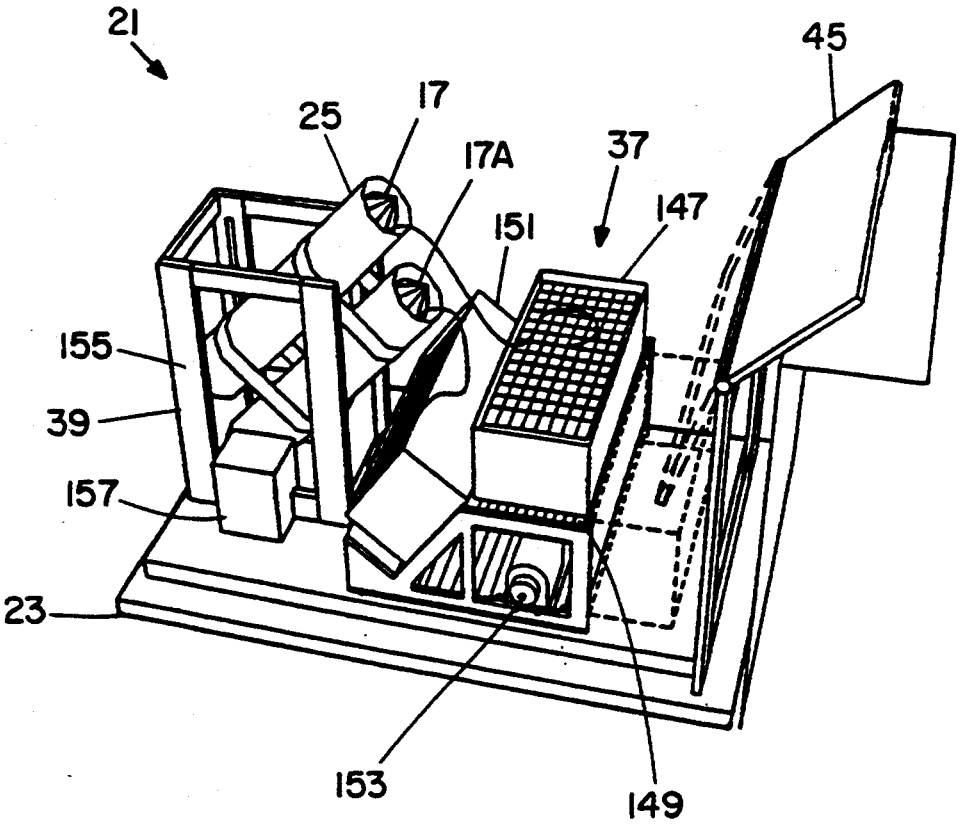
FIG. 19 illustrates the launcher assembly of FIGS. 1, 17 and 18 in a stowed position.
Figure 20:
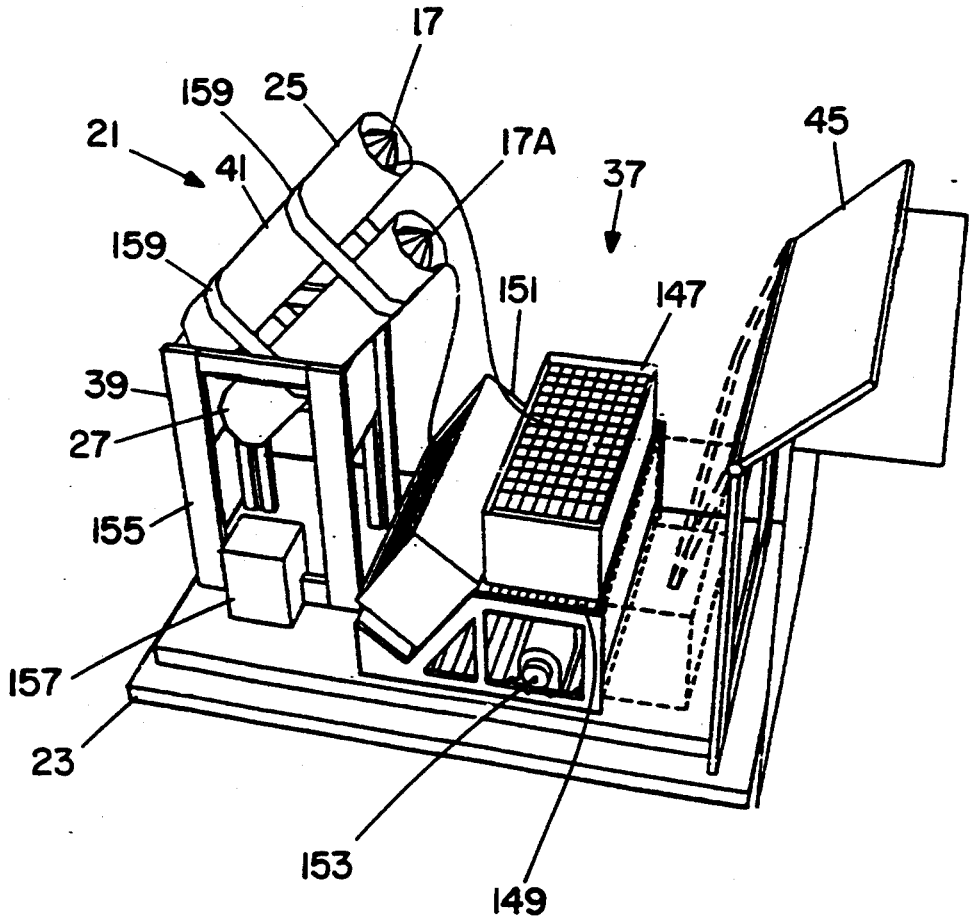
FIG. 20 illustrates the launcher assembly of FIGS. 1 and 17–19 in a deployed, firing position.

Launcher lifting subassembly 39 raises tube assembly 41 for firing to increase clearance between the rockets and the vehicle, and then lowers tube assembly 41 for transport. Launcher lifting subassembly 39 includes lift guides 155 and an electric lift cylinder 157. The mechanical action is extension of the electric lift cylinder vertically, with alignment of launch tube assembly 41 maintained by launcher lifting guides 155. FIG. 19 shows launcher assembly 21 in its stowed position, while FIG. 20 shows launcher assembly 21 in its firing (deployed) position.

Launch tube subassembly 41 includes the two launch tubes 25 and 27, and inter-tube stabilizer 159.

The two launch tubes 25 and 27 are non-rifled, unvented structures which each support and house a rocket, slip collar, extension assembly and extension arms (and optionally a parasail) prior to launch. Each tube 25 and 27 also provides cable guides 141, 143 (see FIG. 21) to prevent cable fouling during launch. Mounted inside and on the top half of each rocket tube 25 and 27 are two clips and a guide 141 and 143 for the tow cables 53 and 55. The guides 141 and 143 for the tow cables 53 and 55 run the length of the interior of each rocket tube 25 and 27 to keep the tow cables from fouling on the slip collar 49 or fin assembly 73 during launch. Rocket guides 145 also run the entire length of each launch tube 25 and 27. Prior to launch, extension arms 33 and 35 are temporarily held to the interior of the launch tube by the clips. This physical connection augments the inertia of the slip collar 49 while the rocket 17 is clearing the launch tube 25 or 27. The clips (not shown) for arms 33 and 35 are respectively connected to the base end of the two upper or top rocket guides to provide some initial resistance for the arms and collar when the rocket first fires. After rocket 17 has passed through slip collar 49 (the collar reaches the rear collar stop 91 on the sleeve 69), the continued forward movement of the rocket and collar snaps the extension arms 33 and 35 free from the clips and the arms move free on the launch tube unencumbered. FIG. 21 shows the placement of the internal rocket guides 145 and the free space to allow the tow cables 53 and 55 and rocket fins 73 to pass unobstructed from the rocket tube.

The inter-tube stabilizer 159 is a physical interface to join the tubes 25 and 27 into a single piece for attachment to the launcher lifting subassembly 39. Additionally, the inter-tube stabilizer 159 provides strength to the tubes 25 and 27, but can be replaced if damaged during rocket launch.

Figure 22:
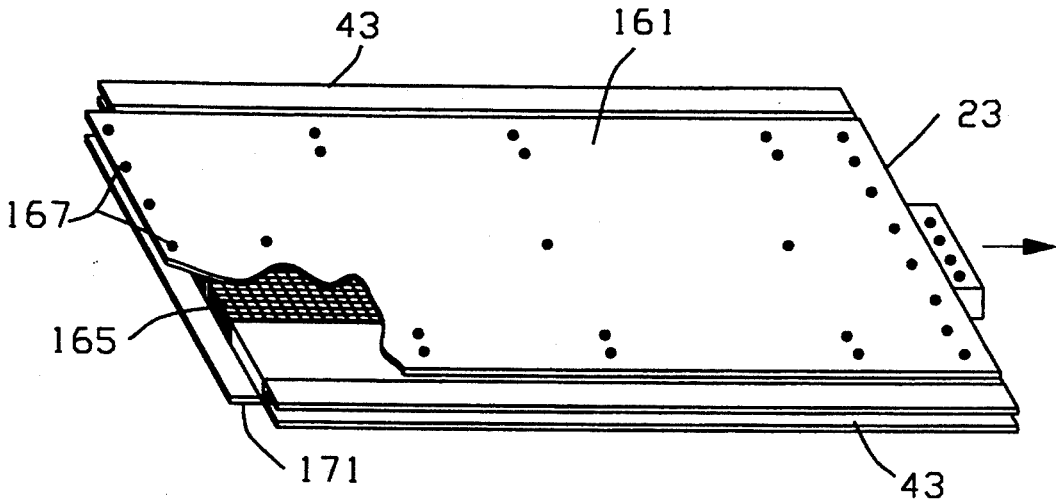
FIG. 22 illustrates the pallet assembly of FIG. 1 in greater detail with a portion thereof shown cut away.
Figure 23:
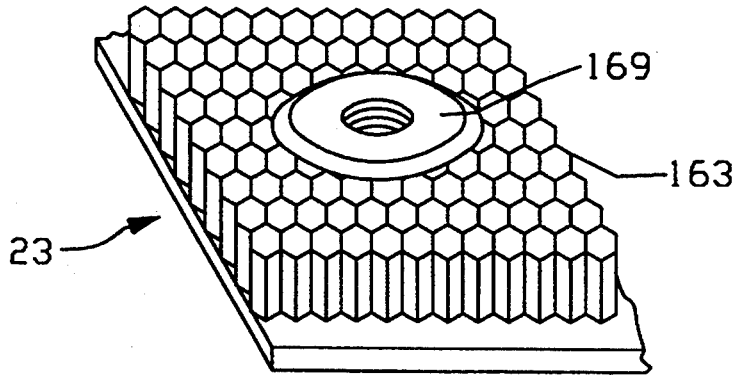
FIG. 23 illustrates a portion of the cutaway portion of FIG. 22 in an enlarged view showing greater detail.
Figure 24:
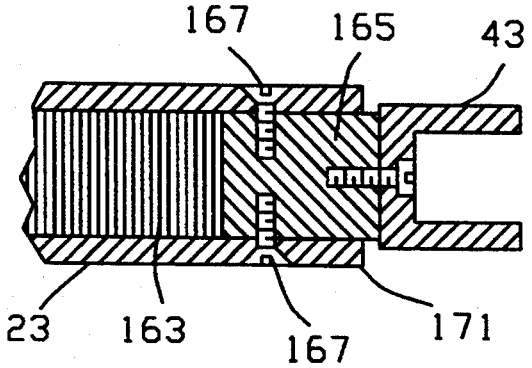
FIG. 24 is a partial sectional view of the pallet assembly of FIG. 22.

Pallet assembly 23 is the basic structure on which the rest of rocket launch assembly 21 is mounted. The pallet assembly 23 is a constant thickness (preferably 1.75 inches) "stressed skin" assembly with aluminum sheets 161 and 171 (each for example 0.187 inch thick) and an aluminum hexagonal honeycomb core 163, as shown in FIGS. 22–24. An aluminum frame 165 closes the edges of honeycomb 163 and is secured with recessed bolts and/or rivets 167. Threaded inserts 169 are placed at load attachment points. The entire pallet assembly 23 is preferably adhesively bonded and cured. This design provides sufficient structural strength while reducing weight. Additionally, there are rail guides 43 along opposite sides of pallet 23 to allow the pallet to be hand cranked into and out of the vehicle 13.

Net deflector 45 is used to prevent the explosives net 19 from snagging on a protrusion from the top surface of the assaulting vehicle (e.g. AAV 13). Although the rocket launch tube assembly 41 is raised for firing to increase the clearance between the rockets and the vehicle, the net deflector 45 provides an additional assurance of unobstructed net 19 delivery.

The launcher lifting subassembly 39 provides additional clearance for the launching rockets, and permits the rockets to be transported in a lower, stowed position. If a fixed launcher is used, then it should be placed in the deployed position. The net deflector 45 provides additional assurance that there will be no net snagging during launch. The magazine positioning subassembly 37 rotates the explosives chests 147 and 151 as required for deployment of the nets, and doubles the number of nets which can be contained in the explosive magazine on any one vehicle.

The explosives chests 147 and 151 provide a means for protecting disposable explosives packaging both prior to launch and during launch. Reloading the net magazine merely requires removing the remaining box insert material from the previous net and sliding the new box insert into position in a chest. The magazine positioning subassembly 37 permits two nets to be moved into the tactical firing position sequentially.

Use of a solid fuel rocket to deploy an explosives net is preferred because of the convenience, ease of storage, simplicity to operate, effectiveness and reliability of the rocket. However, it should be understood that the present invention can be utilized with a projectile other than a solid fuel rocket. However, for effective deployment of a linear array at a fair distance from the launch site, a self-propelled projectile such as a rocket is preferred.

Also, although the present invention provides the capability to deploy an explosives net, the present invention can be used to deploy other flexible arrays than an explosives net. For example, the present invention could be used by fishermen to deploy a fishing net from a boat.

Some of the many advantages of the present invention should now be readily apparent. For example, apparatus and method have been provided for reliably deploying a flexible array. This apparatus and method is capable of reliably deploying and spreading a collapsible net. This apparatus and method is capable of being disposed on, and deploying and spreading a flexible array from, a variety of vehicles and other platforms. The flexible array can for example be a wide area explosive array. The apparatus and method are thus capable of distributed explosives delivery such as in support of in-stride amphibious assault and surf zone lane breaching. An explosives array can thereby be reliably deployed and spread from a single rocket delivery system. The apparatus and method of the present invention is capable of deploying a flexible array so that the array is properly placed and does not foul on the launch vehicle or other platform.

The present invention is capable of delivering an explosives net or a linear explosives array or net forward of a launch vehicle such as an amphibious vehicle. The pallet assembly permits a vehicle to have temporary modifications made (e.g. to accommodate the rails) which allow the vehicle to conduct mine neutralization missions in the surf and on land. The present invention also permits the vehicle to revert to non-mine clearing missions after the rocket(s) on board have been fired. The present invention can use existing rockets, and thereby does not require development of new ordnance. The firing of a single rocket with a single arm extension gas generator eliminates the problem of trying to simultaneously fire two or more rockets to spread a net over the target area.

The design of the rocket kit sleeve and slip collar strengthens a rocket fuselage and adapts the rocket for explosive array placement without modification. The cable configuration provides counter-balanced loading on the extension arms. The design of the extension arm assembly permits spreading of the extension arms and retaining them once spread.

Obviously, many modifications and variations of the present invention are possible in light of the above teachings. It is therefore to be understood that the foregoing embodiments are presented by way of example only and that, within the scope of the appended claims and equivalents thereto, the invention may be practiced otherwise than as specifically described.

What is claimed is:

1. A flexible array and apparatus for deploying said flexible array, comprising:

said flexible array;

propulsion means for providing propulsion upon request;

a collar slidably disposed on said propulsion means;

a first stop for limiting rearward travel of said collar relative to said propulsion means;

first and second members pivotably connected to said collar, wherein said first and second members each have a free end separately connected to said flexible array; and first moving means, connected to said collar and to said first and second members, for moving said first and second members angularly away from each other to spread apart said members.

2. Apparatus as recited in claim 1, further comprising retaining means, connected to said collar, for retaining said first and second members in a position in which they are angularly separated from each other, upon movement thereto of said members by said moving means.

3. Apparatus as recited in claim 1 wherein said flexible array comprises a net.

4. Apparatus as recited in claim 1 wherein said flexible array comprises an explosive net.

5. Apparatus as recited in claim 1 wherein said first member and said second member are pivotably connected to said collar by a single pivot.

6. Apparatus as recited in claim 5, further comprising releasing means for releasing said first and second members from said pivot after elapse of a predetermined time from first requested provision of propulsion by said propulsion means.

7. Apparatus as recited in claim 1, further comprising:

a flexible cap disposed on the front of said propulsion means; and a sleeve disposed on said propulsion means, and connected to said cap, wherein said sleeve is disposed between said propulsion means and said collar, and wherein said collar is slidable on said sleeve.

8. Apparatus as recited in claim 7, further comprising a guide, fixed to said sleeve and on which said collar is slidable, for guiding movement of said collar on said sleeve.

9. Apparatus as recited in claim 7 wherein said first stop is connected to said sleeve.

10. Apparatus as recited in claim 7, further comprising:

a first line connected at one end to said free end of said first member and slidably connected to said sleeve at a first location forward of said first stop; and a second line connected at one end to said free end of said second member, slidably connected to said sleeve at a second location forward of said first stop, and connected at its other end to the other end of said first line.

11. Apparatus as recited in claim 10 wherein said first and second lines are connected at their respective other ends by a third member connected to the flexible array.

12. Apparatus as recited in claim 10, further comprising a second stop connected to said sleeve forward of said first stop, wherein said first and second locations are disposed on said second stop.

13. Apparatus for deploying a flexible array, comprising:

propulsion means for providing propulsion upon request;

a collar slidably disposed on said propulsion means;

a first stop for limiting rearward travel of said collar relative to said propulsion means;

first and second members pivotably connected to said collar, wherein said first and second members each have a free end adapted to be separately connectable to a flexible array; and first moving means, connected to said collar and to said first and second members, for moving said first and second members angularly away from each other to spread apart said members, wherein said first member is configured to be extendable in at least one direction;

wherein said second member is configured to be extendable in at least one direction; and said apparatus further comprises extending means, connected to said collar, said first member and said second member, for causing said first and second members to so extend.

14. Apparatus for deploying a flexible array, comprising:

propulsion means for providing propulsion upon request;

a collar slidably disposed on said propulsion means;

a first stop for limiting rearward travel of said collar relative to said propulsion means;

first and second members pivotably connected to said collar, wherein said first and second members each have a free end adapted to be separately connectable to a flexible array, wherein said first member is extendable in at least one direction and said second member is extendable in at least one direction;

extending means, connected to said collar, said first member and said second member, for causing said first and second members to so extend;

first moving means, connected to said collar and to said first and second members, for moving said first and second members angularly away from each other to spread apart said members; and control means for preventing operation of said extending means until said moving means has angularly moved said first and second members.

15. Apparatus for deploying a flexible array, comprising:

propulsion means for providing propulsion upon request;

a collar slidably disposed on said propulsion means;

a first stop for limiting rearward travel of said collar relative to said propulsion means;

first and second members pivotably connected to said collar, wherein said first and second members each have a free end adapted to be separately connectable to a flexible array;

first moving means, connected to said collar and to said first and second members, for moving said first and second members angularly away from each other to spread apart said members; and a clam shell, connected to said collar, for retaining said first and second members in a position in which they are angularly separated from each other, upon movement thereto of said members by said moving means.

16. Apparatus for deploying a flexible array, comprising:

propulsion means for providing propulsion upon request;

a collar slidably disposed on said propulsion means;

a first stop for limiting rearward travel of said collar relative to said propulsion means;

first and second members pivotably connected to said collar by a single pivot, wherein said first and second members each have a free end adapted to be separately connectable to a flexible array; and first moving means, connected to said collar and to said first and second members, for moving said first and second members angularly away from each other to spread apart said members.

17. Apparatus as recited in claim 16, further comprising releasing means for releasing said first and second members from said pivot after elapse of a predetermined time from first requested provision of propulsion by said propulsion means.

18. Apparatus for deploying a flexible array, comprising:

propulsion means for providing propulsion upon request;

a collar slidably disposed on said propulsion means;

a first stop for limiting rearward travel of said collar relative to said propulsion means;

first and second members pivotably connected to said collar, wherein said first and second members each have a free end adapted to be separately connectable to a flexible array;

first moving means, connected to said collar and to said first and second members, for moving said first and second members angularly away from each other to spread apart said members;

a flexible cap disposed on the front of said propulsion means; and a sleeve disposed on said propulsion means, and connected to said cap, wherein said sleeve is disposed between said propulsion means and said collar, wherein said first stop is connected to said sleeve, and wherein said collar is slidable on said sleeve.

19. Apparatus as recited in claim 18, further comprising a guide, fixed to said sleeve and on which said collar is slidable, for guiding movement of said collar on said sleeve.

20. Apparatus as recited in claim 18, further comprising:

a first line connected at one end to said free end of said first member and slidably connected to said sleeve at a first location forward of said first stop; and a second line connected at one end to said free end of said second member, slidably connected to said sleeve at a second location forward of said first stop, and connected at its other end to the other end of said first line.

21. Apparatus as recited in claim 20 wherein said first and second lines are connected at their respective other ends by a third member adapted to be connected to the flexible array.

22. Apparatus as recited in claim 20, further comprising a second stop connected to said sleeve forward of said first stop, wherein said first and second locations are disposed on said second stop.

23. Apparatus for deploying a flexible array, comprising:

propulsion means for providing propulsion upon request;

a collar slidably disposed on said propulsion means;

a first stop for limiting rearward travel of said collar relative to said propulsion means;

first and second members pivotably connected to said collar, wherein said first and second members each have a free end adapted to be separately connectable to a flexible array; and first moving means, connected to said collar and to said first and second members, for moving said first and second members angularly away from each other to spread apart said members, wherein said first member comprises a plurality of telescoping sections configured such that said first member is extendable in at least one direction;

wherein said second member comprises a plurality of telescoping sections configured such that said second member is extendable in at least one direction; and wherein said apparatus further comprises extending means, connected to said collar, said first member and said second member, for causing said first and second members to so extend.

24. Apparatus for deploying a flexible array, comprising:

propulsion means for providing propulsion upon request;

a collar slidably disposed on said propulsion means;

a first stop for limiting rearward travel of said collar relative to said propulsion means;

first and second members pivotably connected to said collar, wherein said first and second members each have a free end adapted to be separately connectable to a flexible array; and first moving means, connected to said collar and to said first and second members, for moving said first and second members angularly away from each other to spread apart said members, wherein said first member comprises first lengthening means for lengthening said first member; and wherein said second member comprises second lengthening means for lengthening said second member.

25. Apparatus as recited in claim 24, further comprising means for causing said first lengthening means to lengthen said first member, and for causing said second lengthening means to lengthen said second member.

26. A method for deploying a flexible array using a propulsion device and a plurality of lengthenable members pivotably and releasably connected to the propulsion device, comprising the steps of:

connecting the flexible array to the members;

propelling the flexible array to a location, using the propelling device;

during said propelling step, pivotably moving the members angularly away from each other to spread apart said members;

during said propelling step, lengthening the members;

after said moving step and said lengthening step, releasing the members from the propelling means.

27. A method as recited in claim 26 wherein said lengthening step follows said moving step.

* * * * *